US008304158B2

(12) United States Patent
Mutoh et al.

(10) Patent No.: US 8,304,158 B2
(45) Date of Patent: Nov. 6, 2012

(54) METHOD FOR MANUFACTURING TONER, TONER, DEVELOPER, DEVELOPING DEVICE, AND IMAGE FORMING APPARATUS

(75) Inventors: Yoshinori Mutoh, Osaka (JP); Yoshiaki Akazawa, Osaka (JP); Yoshitaka Kawase, Osaka (JP); Yoritaka Tsubaki, Osaka (JP); Keiichi Kikawa, Osaka (JP); Takashi Hara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 421 days.

(21) Appl. No.: 12/637,263

(22) Filed: Dec. 14, 2009

(65) Prior Publication Data

US 2010/0159374 A1 Jun. 24, 2010

(30) Foreign Application Priority Data

Dec. 18, 2008 (JP) ..... P2008-322968

(51) Int. Cl.
*G03G 9/08* (2006.01)

(52) U.S. Cl. ..... 430/137.1; 430/137.11; 430/137.14; 430/137.15

(58) Field of Classification Search ..... 430/137.1, 430/137.11, 137.14, 137.15
See application file for complete search history.

(56) References Cited

U.S. PATENT DOCUMENTS

| | | | | |
|---|---|---|---|---|
| 4,915,987 | A | 4/1990 | Nara et al. | |
| 5,215,854 | A | 6/1993 | Yamazaki et al. | |
| 5,296,266 | A | 3/1994 | Kunugi et al. | |
| 2008/0166156 | A1 | 7/2008 | Kawase | |
| 2009/0297224 | A1 * | 12/2009 | Kawase et al. | 399/252 |

FOREIGN PATENT DOCUMENTS

| | | | |
|---|---|---|---|
| JP | 64-42660 | | 2/1989 |
| JP | 2-256062 | A | 10/1990 |
| JP | 4-182669 | | 6/1992 |
| JP | 4-211269 | | 8/1992 |
| JP | 5-10971 | | 2/1993 |
| JP | 2008-191639 | A | 8/2008 |

* cited by examiner

*Primary Examiner* — Thorl Chea
(74) *Attorney, Agent, or Firm* — Nixon & Vanderhye, P.C.

(57) ABSTRACT

A method for manufacturing a toner includes a pre-mixing step and a coating step. In the pre-mixing step, a secondary aggregate of the fine resin particles is disaggregated, while toner base particles and fine resin particles are mixed and stirred using a rotary stirring apparatus. Thus obtained disaggregated fine resin particles are fixed to the surface of the toner base particle. Thus, a fine resin particle-fixed toner is obtained. The rotary stirring apparatus includes a rotary stirring section, a temperature regulation section, a circulating section, and a spraying section. In the coating step, a liquid is sprayed to the fine resin particle-fixed toner with the spraying section using the rotary stirring apparatus. Thus, a film of the fine resin particles is formed. In the pre-mixing step and the coating step, temperature regulation is conducted in the temperature regulation section.

13 Claims, 7 Drawing Sheets

METHOD FOR MANUFACTURING TONER, TONER, DEVELOPER, DEVELOPING DEVICE, AND IMAGE FORMING APPARATUS

CROSS-REFERENCE TO RELATED APPLICATION

This application claims priority to Japanese Patent Application No. 2008-322968, which was filed on Dec. 18, 2008, the contents of which are incorporated herein by reference in their entirety.

BACKGROUND OF THE INVENTION

1. Field of the Invention

The present invention relates to a method for manufacturing a toner, a toner obtained by the production method, a developer containing the toner, a developing device using the developer, and an image forming apparatus.

2. Description of the Related Art

Conventionally, a surface modification treatment for coating the surface of powder particles with a coating material has been carried out in order to improve characteristics of the powder particles such as toner particles.

As a method for the surface modification treatment of the powder particles such as toner particles, a method is known that a mechanical stirring force is applied to the powder particles by a rotary stirring section such as a screw, blade, or rotor to fluidize the powder particles in a powder passage and a coating material is ejected from a spray nozzle to the powder particles in a fluid state.

In the surface modification treatment method, a method of covering a surface of power particles with a coating material contained a liquid by spraying the liquid from a spray nozzle is disclosed in Japanese Examined Patent Publication JP-B2 5-10971 (1993). Specifically, powder particles are fluidized by rotating a rotary stirring apparatus in a peripheral speed of 5 to 160 m/sec, and a liquid is sprayed to the powder particles under the fluidized state from a spray nozzle. This method can fix and form a film of a coating material constituting fine solid particles contained in a liquid or the liquid onto the surface of the powder particles. According to the method disclosed in JP-B2 5-10971, adhesion between the coating material and the powder particles can be increased, and additionally, time required in the surface modification treatment can be shortened.

Further, Japanese Unexamined Patent Publication JP-A 4-211269 (1992) discloses a method for manufacturing a microcapsule in which resin particles are adhered to the surface of inner core particles and are treated with a solvent that dissolves the resin particles to form a coating layer on the surface of the inner core particles. The method for manufacturing a microcapsule disclosed in JP-A 4-211269 comprises at least a step of adhering the resin particles to the surface of the inner core particles, a step of treating resin particles with a solvent that dissolves the resin particles, and a step of drying and recovering the treated particles.

However, the method disclosed in JP-B2 5-10971 has the following problem. In the case that powder particles are fluidized by applying mechanical stirring force in a rotary stirring apparatus and a liquid containing a coating material is sprayed to the powder particles in the fluidized state, powder particles must be fluidized in an isolated state in order to obtain covered particles comprising the powder particles uniformly coated with the coating material. To fluidize the powder particles in an isolated state, a peripheral speed of the rotary stirring apparatus must be increased to a certain extent. However, where the peripheral speed of the rotary stirring apparatus is increased, a fluidizing speed of the powder particles is increased, and frequency that the powder particles collide with an inner wall of an apparatus is increased. Where the frequency that the powder particles collide with an inner wall of an apparatus is excessively increased, the problem arises that the powder particles are easily adhered to the inner wall of an apparatus, and other powder particles and coating material aggregate and grow by acting the adhered powder particles as nuclei. Where the powder particles and the coating material aggregate and grow on the inner wall of an apparatus, the powder particles fluidize. This gives rise to the problem that flow passage is narrowed, thereby preventing fluidization in an isolated state and the problem of decrease in yield.

Since the treatment is carried out by the use of the solvent that dissolves a resin of the resin particles in the method disclosed in the JP-A 4-211269, the solvent taken in the resin of the resin particles hardly vaporizes and a large amount of the aggregate is generated even when the inner core particles and the resin particles are fluidized at high speed. Further, large amounts are adhered to the inner wall of the apparatus, which are difficult to be recovered in a state of primary particles, and the method does not provide excellent productivity. There is a possibility that some kinds of solvents dissolve even the inner core particles so that waxes contained in the inner core particles and the like are adhered and exposed to the surface of the inner core particles as particles, and when using the obtained microcapsule particles as a toner, toner performance including storing performance and fixing performance of the toner is deteriorated.

SUMMARY OF THE INVENTION

An object of the invention is to provide a method for manufacturing a toner in high yield, in which a surface of a toner base particle is coated with a resin layer while maintaining powder particles in a fluidized state, thereby suppressing aggregation and adhesion in an apparatus, a toner obtained by the production method, a developer containing the toner, a developing device using the developer, and an image forming apparatus.

Furthermore, another object of the invention is to provide a method for manufacturing a toner, in which film uniformity of resin particles to the surface of core particles can be improved without adhering the core particles and the resin particles to the inside of an apparatus and without generating an aggregate, a toner obtained by the production method, a developer containing the toner, a developing device using the developer, and an image forming apparatus.

The invention provides a method for manufacturing a toner having a film which is formed on a toner base particle containing a binder resin and a colorant by adhering fine resin particles to a surface of the toner base particle, comprising:

a pre-mixing step of obtaining a fine resin particle-fixed toner by fixing disaggregated fine resin particles obtained by disaggregating a secondary aggregate of fine resin particles, to a surface of the toner base particle, while mixing and stirring toner base particles and the fine resin particles using a rotary stirring apparatus, the rotary stirring apparatus comprising a rotary stirring section including a rotary disk having rotary vanes provided on the circumference thereof, and a rotary shaft, a temperature regulation section which is provided in at least a part of a powder passage including a rotary stirring chamber and a circulation tube and regulates the temperature in the rotary stirring section and the powder passage to a predetermined temperature, a circulating section which repeatedly circulates toner base particles and fine resin particles in the powder passage by the rotary stirring section, and a spraying section which sprays a liquid having the effect of plasticizing the toner base particle and the fine resin particles; and a coating step of spraying the liquid to the fine resin particle-fixed toner in a fluidized state obtained in the pre-mixing step with the spraying section, and spreading the fine resin particles on the surface of the toner base particle, thereby forming a film of the fine resin particles, using the rotary stirring apparatus, in the pre-mixing step and the coating step, temperature regulation being conducted in the temperature regulation section, and a pre-mixing stabilization temperature which is a temperature in the powder passage, elevated from the initiation point of the pre-mixing step and stabilized in the pre-mixing step being lower than a coating stabilization temperature which is a temperature in the powder passage, elevated from the initiation point of the coating step and stabilized in the coating step.

According to the invention, the method for manufacturing a toner having a film which is formed on a toner base particle containing a binder resin and a colorant by adhering fine resin particles to a surface of the toner base particle includes a pre-mixing step and a coating step. In the pre-mixing step, a secondary aggregate of fine resin particles is disaggregated fine resin particles while toner base particles and the fine resin particles are mixed and stirred using a rotary stirring apparatus. Thus obtained disaggregated fine resin particles are fixed to a surface of the toner base particle. Thus, a fine resin particle-fixed toner is obtained. The rotary stirring apparatus comprises a rotary stirring section including a rotary disk having rotary vanes provided on the circumference thereof, and a rotary shaft, a temperature regulation section which is provided in at least a part of a powder passage including a rotary stirring chamber and a circulation tube and regulates the temperature in the rotary stirring section and the powder passage to a predetermined temperature, a circulating section which repeatedly circulates toner base particles and fine resin particles in the powder passage by the rotary stirring section, and a spraying section which sprays a liquid having the effect of plasticizing the toner base particle and the fine resin particles. In the coating step, the liquid is sprayed to the fine resin particle-fixed toner in a fluidized state obtained in the pre-mixing step with the spraying section using the rotary stirring apparatus, and the fine resin particles are spread on the surface of the toner base particle. Thus, a film of the fine resin particles is formed. In the pre-mixing step and the coating step, temperature regulation is conducted with the temperature regulation section.

The fine resin particles are in an aggregated state before mixing with the toner base particles. When a film of the fine resin particles is formed by spraying a liquid having a plasticization effect to the toner base particle and the fine resin particles without disaggregating an aggregate of the fine resin particles, the aggregated fine resin particles are adhered and fixed to the surface of the toner base particle. As a result, a film having nonuniform film thickness and the like is formed. By conducting the pre-mixing step, that is, by conducting a disaggregating treatment of the fine resin particles in a liquid unsprayed state as the pre-step of film formation by liquid spraying, the fine resin particles can be fixed to the surface of the toner base particle in the state where an aggregate is disaggregated, and a spread treatment of the fine resin particles by liquid spraying is conducted in this state. As a result, a film free of exposure of the toner base particle and having high uniformity can be formed.

By conducting temperature regulation in the pre-mixing step and the coating step, respectively, temperature can be regulated to the optimum temperature in each step. As a result, a resin film having higher uniformity can be formed. Specifically, by conducting temperature regulation in the pre-mixing step, rapid temperature increase inducing softening of the fine resin particles which hinders disaggregating can be suppressed. Furthermore, the temperature regulation can prevent the disadvantage that the toner base particle and the fine resin particles in a fluidized state store heat and soften by the collision with the rotary stirring section and the inner wall of the powder passage, and adhere to the rotary stirring section and the inner wall of the powder passage. As a result, the yield of the fine resin particle-fixed toner is improved. By conducting temperature regulation in the coating step, the temperature regulation can prevent the disadvantage that the fine resin particle-fixed toner in a fluidized state stores heat and softens by the collision with the rotary stirring section and the inner wall of the powder passage, and adheres to the rotary stirring section and the inner wall of the powder passage. Therefore, this can suppress that other toner particles and the fine resin particles are aggregated and grown by acting the adhered fine resin particle-fixed toner as a nucleus, and can prevent that the passage for fluidizing the fine resin particle-fixed toner is narrowed by aggregation. As a result, the yield of the toner can be improved.

The pre-mixing stabilization temperature which is a temperature in the powder passage, elevated from the initiation point of the pre-mixing step and stabilized in the pre-mixing step is lower than the coating stabilization temperature which is a temperature in the powder passage, elevated from the initiation point of the coating step and stabilized in the coating step. By so doing, the fine resin particles are fixed to the surface of the toner base particle in a small exposure state in the pre-mixing step. In the coating step, spreading treatment of the fine resin particles is conducted in a stable manner, and a film having less irregularity on the surface and having a uniform film thickness can be formed.

By using the same apparatus as treatment apparatuses conducting the pre-mixing step and the coating step, capital investment is inexpensive and the space of installation site can be saved.

The invention further provides a method for manufacturing a toner having a film which is formed on a toner base particle containing a binder resin and a colorant by adhering fine resin particles to a surface of the toner base particle, comprising:

a pre-mixing step of obtaining a fine resin particle-fixed toner by fixing disaggregated fine resin particles obtained by disaggregating a secondary aggregate of fine resin particles, to the surface of the toner base particle, while mixing and stirring toner base particles and fine resin particles using a first rotary stirring apparatus, the first rotary stirring apparatus comprising a first rotary stirring section including a rotary disk having rotary vanes provided on the circumference thereof, and a rotary shaft, and a first temperature regulation section which is provided in at least a part of a first powder passage including a first rotary stirring chamber and a first circulation tube and regulates the temperature in a first powder passage and the first rotary stirring section to a predetermined temperature; and a coating step of spraying a liquid having the effect of plasticizing the fine resin particle-fixed toner to the fine resin particle-fixed toner in a fluidized state obtained in the pre-mixing step with a spraying section, and spreading the fine resin particles on the surface of the toner base particle, thereby forming a film of the fine resin particles, using a second rotary stirring apparatus, the second rotary stirring apparatus comprising a second rotary stirring section including a rotary disk having rotary vanes provided on the circumference thereof, and a rotary shaft, a second temperature regulation section which is provided in at least a part of a second powder passage including a second rotary stirring chamber and a second circulation tube and regulates the temperature in the second rotary stirring section and the second powder passage to a predetermined temperature, a circulating section which repeatedly circulates the fine resin particle-fixed toner in the powder passage with the second rotary stirring section, and the spraying section which sprays the liquid, in the pre-mixing step, temperature regulation being conducted in the first temperature regulation section, in the coating step, temperature regulation being conducted in the second temperature regulation section, and a pre-mixing stabilization temperature which is a temperature in the first powder passage, elevated from the initiation point of the pre-mixing step and stabilized in the pre-mixing step being lower than a coating stabilization temperature which is a temperature in the second powder passage, elevated from the initiation point of the coating step and stabilized in the coating step.

According to the invention, the method for manufacturing a toner having a film which is formed on a toner base particle containing a binder resin and a colorant by adhering fine resin particles to a surface of the toner base particle includes a pre-mixing step and a coating step. In the pre-mixing step, a secondary aggregate of fine resin particles is disaggregated while toner base particles and the fine resin particles are mixed and stirred using a first rotary stirring apparatus. Thus obtained disaggregated fine resin particles are fixed to the surface of the toner base particle. Thus, a fine resin particle-fixed toner is obtained. The first rotary stirring apparatus comprises a first rotary stirring section including a rotary disk having rotary vanes provided on the circumference thereof, and a rotary shaft, and a first temperature regulation section which is provided in at least a part of a first powder passage including a first rotary stirring chamber and a first circulation tube and regulates the temperature in the first powder passage and the first rotary stirring section to a predetermined temperature. In the coating step, a liquid having the effect of plasticizing the fine resin particle-fixed toner is sprayed to the fine resin particle-fixed toner in a fluidized state obtained in the pre-mixing step with a spraying section, and the fine resin particles are spread on the surface of the toner base particle, using a second rotary stirring apparatus. Thus, a film of the fine resin particles is formed. The second rotary stirring apparatus comprises a second rotary stirring section including a rotary disk having rotary vanes provided on the circumference thereof, and a rotary shaft, a second temperature regulation section which is provided in at least a part of a second powder passage including a second rotary stirring chamber and a second circulation tube and regulates the temperature in the second rotary stirring section and the second powder passage to a predetermined temperature, a circulating section which repeatedly circulates the fine resin particle-fixed toner in the second powder passage with the second rotary stirring section, and the spraying section which sprays the liquid. In the pre-mixing step, temperature regulation is conducted in the first temperature regulation section. In the coating step, temperature regulation is conducted in the second temperature regulation section.

The fine resin particles are in an aggregated state before mixing with the toner base particle. Where a film of the fine resin particles is formed by spraying a liquid having a plasticization effect to the toner base particle and the fine resin particles without disaggregating an aggregate of the fine resin particles, the aggregated fine resin particles are adhered and fixed to the surface of the toner base particle. As a result, a film having nonuniform film thickness and the like is formed. By conducting the pre-mixing step, that is, by conducting a disaggregating treatment of the fine resin particles in a liquid-unsprayed state as the pre-step of film formation by liquid spraying, the fine resin particles can be fixed to the surface of the toner base particle in the state where an aggregate is disaggregated, and a spread treatment of the fine resin particles by liquid spraying is conducted in this state. As a result, a film free of exposure of the toner base particle and having high uniformity can be formed.

By conducting temperature regulation in the pre-mixing step and the coating step, respectively, temperature can be regulated to the optimum temperature in each step. As a result, a resin film having higher uniformity can be formed. Specifically, by conducting temperature regulation in the pre-mixing step, rapid temperature increase inducing softening of the fine resin particles which hinders disaggregating can be suppressed. Furthermore, the temperature regulation can prevent the disadvantage that the toner base particle and the fine resin particles in a fluidized state store heat and soften by the collision with the first rotary stirring section and the inner wall of the powder passage, and adhere to the rotary stirring section and the inner wall of the rotary stirring chamber. As a result, the yield of the fine resin particle-fixed toner is improved. By conducting temperature regulation in the coating step, the temperature regulation can prevent the disadvantage that the fine resin particle-fixed toner in a fluidized state store heat and soften by the collision with the second rotary stirring section and the inner wall of the second powder passage, and adhere to the second rotary stirring section and the inner wall of the second powder passage. Therefore, this can suppress that other toner particles and fine resin particles are aggregated and grown by acting the fixed fine resin particle-fixed toner as a nucleus, and can prevent that the passage for fluidizing the fine resin particle-fixed toner is narrowed by aggregation. As a result, the yield of the toner can be improved.

The pre-mixing stabilization temperature which is a temperature in the first powder passage, elevated from the initiation point of the pre-mixing step and stabilized in the pre-mixing step is lower than a coating stabilization temperature which is a temperature in the second powder passage, elevated from the initiation point of the coating step and stabilized in the coating step. By so doing, the fine resin particles are fixed to the surface of the toner base particle in a small exposure state in the pre-mixing step. In the coating step, spreading treatment of the fine resin particles is conducted in further stable manner, and a film having less irregularity on the surface and having a uniform film thickness can stably be formed.

Further, in the invention, it is preferable that when manufacturing plural toners, a continuous concurrent treatment is conducted such that the coating step for manufacturing a toner is conducted with the second rotary stirring apparatus, and simultaneously, the pre-mixing step for manufacturing a toner different from the toner in which the coating step is conducted is conducted with the first rotary stirring apparatus.

According to the invention, when manufacturing plural toners, a continuous concurrent treatment is conducted such that that the coating step for manufacturing a toner is conducted in the second rotary stirring apparatus, and simultaneously, the pre-mixing step for manufacturing a toner different from the toner in which the coating step is conducted is conducted in the first rotary stirring apparatus. Therefore, processing capacity when manufacturing plural toners is improved, and productivity of a toner per unit time can be improved as compared with the case that a continuous concurrent treatment is not conducted.

Further, in the invention, it is preferable that in the pre-mixing step and the coating step, the temperature in the powder passage in the pre-mixing step is always lower than the temperature in the powder passage in the coating step in the same elapsed time from the initiation of the respective steps.

According to the invention, in the same time in the elapsed time from the initiation of the respective pre-mixing step and coating step, the temperature in the powder passage in the pre-mixing step is always lower than the temperature in the powder passage in the coating step. This can suppress the fine resin particles from softening, and can sufficiently disaggregate the secondary aggregate of the fine resin particles, in the pre-mixing step. As a result, the disaggregated fine resin particles can uniformly be adhered to the surface of the toner base particle. In the coating step, spreading treatment of the fine resin particles uniformly adhered to the surface of the toner base particle can stably be conducted. Therefore, a toner having good coating uniformity can be obtained.

Further, in the invention, it is preferable that in the pre-mixing step and the coating step, the temperature in the first powder passage in the pre-mixing step is always lower than the temperature in the second powder passage in the coating step in the same elapsed time from the initiation of the respective steps.

According to the invention, in the same time in the elapsed time from the initiation of the respective pre-mixing step and coating step, the temperature in the first powder passage in the pre-mixing step is always lower than the temperature in the second powder passage in the coating step. This can suppress the fine resin particles from softening, and can sufficiently disaggregate the secondary aggregate of the fine resin particles, in the pre-mixing step. As a result, the disaggregated fine resin particles can uniformly be adhered to the surface of the toner base particle. In the coating step, spreading treatment of the fine resin particles uniformly adhered to the surface of the toner base particle can stably be conducted. Therefore, a toner having good coating uniformity can be obtained.

Further, in the invention, it is preferable that the pre-mixing step includes:

a first temperature regulation step of regulating the temperature in the rotary stirring section and the powder passage to 55° C. or lower by the temperature regulation section;

a disaggregating step of disaggregating a secondary aggregate of the fine resin particles by inputting the toner base particles and the fine resin particles into the rotary stirring chamber in which the rotary stirring section rotates; and a fixation step of fixing the disaggregated fine resin particles to the surface of the toner base particle.

According to the invention, the pre-mixing step includes a first temperature regulation step of regulating the temperature in the rotary stirring section and the powder passage to 55° C. or lower by the temperature regulation section, a disaggregating step of disaggregating a secondary aggregate of the fine resin particles by inputting the toner base particles and the fine resin particles into the rotary stirring chamber in which the rotary stirring section rotates, and a fixation step of fixing the disaggregated fine resin particles to the surface of the toner base particle. By regulating the temperature in the powder passage to 55° C. or lower in the first temperature regulation step, the fine resin particles can sufficiently be disaggregated, and after disaggregating, the fine resin particles can be adhered and fixed to the surface of the fine resin particles by utilizing temperature increase due to stirring of the toner base particles and the fine resin particles. As a result, the film can further be uniformed. Further, fixation to the rotary stirring section and the powder passage can be prevented. As a result, the yield of the fine resin particle-fixed toner can further be improved.

Further, in the invention, it is preferable that the pre-mixing step includes:

a first temperature regulation step of regulating the temperature in the first rotary stirring section and the first powder passage to 55° C. or lower by the first temperature regulation section;

a disaggregating step of disaggregating a secondary aggregate of the fine resin particles by inputting the toner base particles and the fine resin particles into the first rotary stirring chamber in which the first rotary stirring section rotates; and a fixation step of fixing the disaggregated fine resin particles to the surface of the toner base particle.

According to the invention, the pre-mixing step includes a first temperature regulation step of regulating the temperature in the first rotary stirring section and the first powder passage to 55° C. or lower by the first temperature regulation section, a disaggregating step of disaggregating a secondary aggregate of the fine resin particles by inputting the toner base particles and the fine resin particles into the first rotary stirring chamber in which the first rotary stirring section rotates, and a fixation step of fixing the disaggregated fine resin particles to the surfaces of the toner base particles. By regulating the temperature to 55° C. or lower in the first temperature regulation step, the fine resin particles can sufficiently be disaggregated, and after disaggregating, the fine resin particles can be adhered and fixed to the surface of the fine resin particles by utilizing temperature increase due to stirring of the toner base particles and the fine resin particles. As a result, the film can further be uniformed. Further, fixation to the first rotary stirring section and the first powder passage can be prevented. As a result, the yield of the fine resin particle-fixed toner can further be improved.

Further, in the invention, it is preferable that the coating step includes:

a second temperature regulation step of regulating the temperature in the rotary stirring section and the powder passage to 50° C. or higher and 55° C. or lower by the temperature regulation section;

a spraying step of spraying the liquid to the fine resin particle-fixed toner in a fluidized state by a carrier gas from the spraying section by inputting the fine resin particle-fixed toner obtained in the pre-mixing step into the powder passage in which the rotary stirring section rotates; and a film-forming step of forming a film of the fine resin particles on the surfaces of the toner base particles by fluidizing the fine resin particle-fixed toner while rotating the rotary stirring section until the fine resin particles on the surface of the toner base particle soften and form a film.

According to the invention, the coating step includes a second temperature regulation step of regulating the temperature in the rotary stirring section and the powder passage to 50° C. or higher and 55° C. or lower by the temperature regulation section, a spraying step of spraying the liquid to the fine resin particle-fixed toner in a fluidized state by a carrier gas from the spraying section by inputting the fine resin particle-fixed toner obtained in the pre-mixing step into the powder passage in which the rotary stirring section rotates, and a film-forming step of forming a film of the fine resin particles on the surfaces of the toner base particles by fluidizing the fine resin particle-fixed toner while rotating the rotary stirring section until the fine resin particles on the surfaces of the toner base particles soften and form a film. By regulating the temperature in the powder passage to 50° C. or higher and 55° C. or lower in the second temperature regulation step, spreading treatment of the fine resin particles can sufficiently be conducted. As a result, a film is further uniformed. Further, aggregation in the rotary stirring section and the powder passage can be prevented. As a result, the yield of a toner can further be improved.

Further, in the invention, it is preferable that the coating step includes:

a second temperature regulation step of regulating the temperature in the second rotary stirring section and the second powder passage to 50° C. or higher and 55° C. or lower by the second temperature regulation section;

a spraying step of spraying the liquid to the fine resin particle-fixed toner in a fluidized state by a carrier gas from the spraying section by inputting the fine resin particle-fixed toner obtained in the pre-mixing step into the second powder passage in which the second rotary stirring section rotates; and a film-forming step of forming a film of the fine resin particles on the surfaces of the toner base particles by fluidizing the fine resin particle-fixed toner while rotating the second rotary stirring section until the fine resin particles on the surfaces of the toner base particles soften and form a film.

According to the invention, the coating step includes a second temperature regulation step of regulating the temperature in the second rotary stirring section and the second powder passage to 50° C. or higher and 55° C. or lower by the second temperature regulation section, a spraying step of spraying the liquid to the fine resin particle-fixed toner in a fluidized state by a carrier gas from the spraying section by inputting the fine resin particle-fixed toner obtained in the pre-mixing step into the second powder passage in which the second rotary stirring section rotates, and a film-forming step of forming a film of the fine resin particles on the surfaces of the toner base particles by fluidizing the fine resin particle-fixed toner while rotating the second rotary stirring section until the fine resin particles on the surfaces of the toner base particles soften and form a film. By regulating the temperature in the powder passage to 50° C. or higher and 55° C. or lower in the second temperature regulation step, spreading treatment of the fine resin particles can sufficiently be conducted. As a result, a film is further uniformed. Further, aggregation in the second rotary stirring section and the second powder passage can be prevented. As a result, the yield of a toner can further be improved.

Further, in the invention, it is preferable that the temperature in the whole powder passage and the rotary stirring section can be regulated to a predetermined temperature by the temperature regulation section in the coating step.

According to the invention, the temperature in the whole powder passage and the rotary stirring section can be regulated to a predetermined temperature by the temperature regulation section in the coating step. This temperature regulation can surely prevent fixation of the toner base particles, the fine resin particles and the fine resin particle-fixed toner, and aggregation growth. As a result, the yield of the fine resin particle-fixed toner and the toner can further be improved.

Further, in the invention, it is preferable that the temperature in the whole second powder passage and the second rotary stirring section can be regulated to a predetermined temperature by the second temperature regulation section in the coating step.

According to the invention, the temperature in the whole second powder passage and the second rotary stirring section can be regulated to a predetermined temperature by the second temperature regulation section in the coating step. This temperature regulation can surely prevent fixation of the toner base particles, the fine resin particles and the fine resin particle-fixed toner, and aggregation growth. As a result, the yield of the fine resin particle-fixed toner and the toner can further be improved.

Further, in the invention, it is preferable that when a peak temperature in the powder passage in the coating step is T2 and a glass transition temperature of the toner base particles is Tg(1), a relationship between T2 and Tg(1) is T2<Tg(1).

According to the invention, when a peak temperature in the powder passage in the coating step is T2 and a glass transition temperature of the toner base particles is Tg(1), a relationship between T2 and Tg(1) is T2<Tg(1). The relationship of T2<Tg(1) can prevent the toner base particles from softening, and can prevent fixation of a powder to the inner wall of the powder passage. As a result, decrease in yield of a toner can be suppressed.

Further, in the invention, it is preferable that when a peak temperature in the second powder passage in the coating step is T2 and a glass transition temperature of the toner base particles is Tg(1), a relationship between T2 and Tg(1) is T2<Tg(1).

According to the invention, when a peak temperature in the second powder passage in the coating step is T2 and a glass transition temperature of the toner base particles is Tg(1), a relationship between T2 and Tg(1) is T2<Tg(1). The relationship of T2<Tg(1) can prevent the toner base particles from softening, and can prevent fixation of a powder to the inner wall of the second powder passage. As a result, decrease in yield of a toner can be suppressed.

Further, the invention provides a toner manufactured by the above-mentioned method for manufacturing a toner.

According to the invention, since a toner of the invention is manufactured by the above-mentioned method for manufacturing a toner, the coated amount of the fine resin particles as the coating material is uniform and toner characteristics such as chargeability between individual toner particles are uniform. Moreover, the toner of the invention is excellent in durability since an effect of protecting a contained component by the resin layer on the surface of the toner is exhibited. By forming an image using such a toner, it is possible to obtain an image that has high definition and high image quality without unevenness in density.

Further, the invention provides a developer containing the toner mentioned above.

According to the invention, the developer contains the toner of the invention. The toner of the invention is uniform in toner characteristics as described above. Therefore, an image of good image quality having high definition and free of density unevenness can be obtained.

Further, in the invention, it is preferable that the developer further comprises a carrier and constitutes a two-component developer.

According to the invention, the developer is a two-component developer comprising the toner of the invention and a carrier. The toner of the invention is uniform in toner characteristics as described above, and has stable chargeability because adhesion of the toner to a carrier can be suppressed by the film on the surface of the toner base particle. As a result, it is possible to obtain an image having high definition and excellent image quality without unevenness in density.

The invention provides a developing device which carries out development using the developer mentioned above.

According to the invention, the developing device carries out development using the developer of the invention. Therefore, it is possible to form a toner image having high definition and excellent image quality without unevenness in density on the surface of the image bearing member.

The invention further provides an image forming apparatus comprising:

an image bearing member on which a latent image is to be formed;

a latent image forming section which forms a latent image on the image bearing member; and the developing device mentioned above.

According to the invention, the image forming apparatus carries out formation of an image using the developing device of the invention. Therefore, it is possible to obtain an image having high definition and excellent image quality without unevenness in density.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
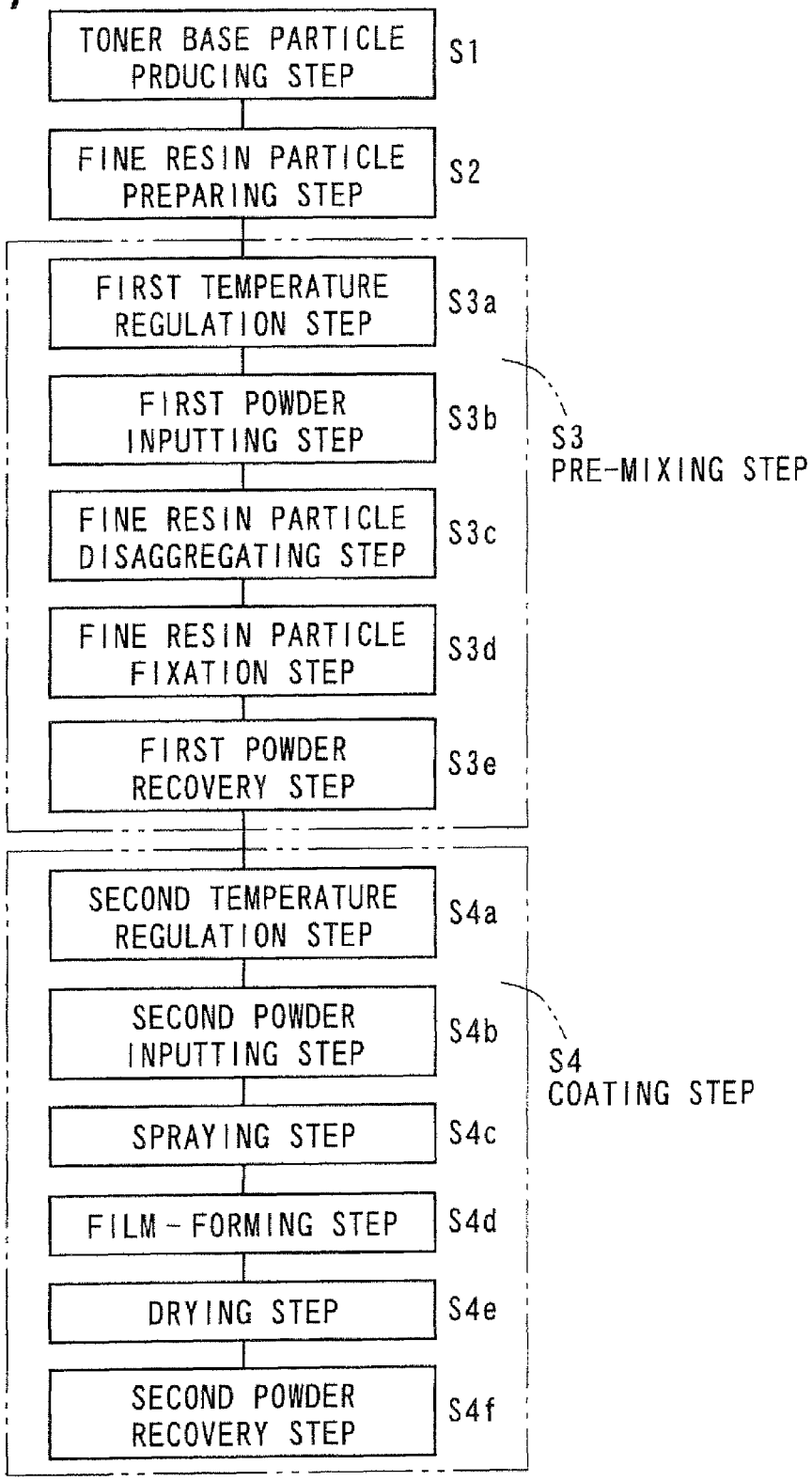
FIG. 1 is a flowchart of an example of a procedure for a method for manufacturing a toner according to a first embodiment of the invention.

Now referring to the drawings, preferred embodiments of the invention are described below.

1. Production Method of Toner

FIG. 1 is a flowchart showing one example of the procedures of the method for manufacturing a toner according to a first embodiment of the invention. The method for manufacturing a toner according to the invention includes a toner base particle producing step S1, a fine resin particle preparing step S2, a pre-mixing step S3, and a coating step S4. The toner base particle producing step S1 prepares toner base particles. The fine resin particle preparing step prepares fine resin particles. In the pre-mixing step, a secondary aggregate of the fine resin particles is disaggregated by an apparatus described hereinafter, and the disaggregated fine resin particles are fixed to the surfaces of the toner base particles. In the coating step, a liquid having the effect of plasticizing the toner base particles and the fine resin particles is sprayed to a fine resin particle-fixed toner. Thus, a film of the fine resin particles is formed.

Hereinafter, each step of the invention will be described.

(1) Toner Base Particle Producing Step S1

In the toner base particle producing step S1, toner base particles to be coated with a resin layer are produced. The toner base particles are particles containing a binder resin and a colorant and are able to be obtained with a known method without particular limitation to a production method thereof. Examples of the method for producing toner base particles include dry methods such as pulverization methods, and wet methods such as suspension polymerization methods, emulsion aggregation methods, dispersion polymerization methods, dissolution suspension methods and melting emulsion methods. The method for producing toner base particles using a pulverization method will be described below.

<Method for Producing Toner Base Particles>

In a method for producing toner base particles using a pulverization method, a toner composition containing a binder resin, a colorant and other additives is dry-mixed by a mixer, and thereafter melt-kneaded by a kneading machine. The kneaded material obtained by melt-kneading is cooled and solidified, and then the solidified material is pulverized by a pulverizing machine. Subsequently, the toner base particles are optionally obtained by conducting regulation of a particle size such as classification.

Usable mixers include heretofore known mixers including, for example, Henschel-type mixing devices such as HENSCHELMIXER (trade name) manufactured by Mitsui Mining Co., Ltd., SUPERMIXER (trade name) manufactured by Kawata MEG Co., Ltd., and MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

Usable kneaders include heretofore known kneaders including, for example, commonly-used kneaders such as a twin-screw extruder, a three roll mill, and a laboplast mill. Specific examples of such kneaders include single or twin screw extruders such as TEM-100B (trade name) manufactured by Toshiba Machine Co., Ltd., PCM-65/87 and PCM-30, both of which are trade names and manufactured by Ikegai, Ltd., and open roll-type kneading machines such as KNEADEX (trade name) manufactured by Mitsui Mining Co., Ltd. Among them, the open roll-type kneading machines are preferable.

Examples of the pulverizing machine include a jet pulverizing machine that performs pulverization using ultrasonic jet air stream, and an impact pulverizing machine that performs pulverization by guiding a solidified material to a space formed between a rotor that is rotated at high speed and a stator (liner).

For the classification, a known classifying machine capable of removing excessively pulverized toner base particles by classification with a centrifugal force or classification with a wind force is usable and an example thereof includes a revolving type wind-force classifying machine (rotary type wind-force classifying machine).

<Raw Materials of Toner Base Particle>

As described above, the toner base particle contains the binder resin and the colorant. The binder resin is not particularly limited and any known binder resin used for a black toner or a color toner is usable, and examples thereof include a styrene resin such as a polystyrene and a styrene-acrylic acid ester copolymer resin, an acrylic resin such as a polymethylmethacrylate, a polyolefin resin such as a polyethylene, a polyester, a polyurethane, and an epoxy resin. Further, a resin obtained by polymerization reaction induced by mixing a monomer mixture material and a release agent may be used.

The binder resins may be used each alone, or two or more of them may be used in combination.

Among the binder resins, polyester is preferable as binder resin for color toner owing to its excellent transparency as well as good powder flowability, low-temperature fixing property, and secondary color reproducibility. For polyester, heretofore known substances may be used including a polycondensation of polybasic acid and polyvalent alcohol.

For polybasic acid, substances known as monomers for polyester can be used including, for example: aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and methyl-esterified compounds of these polybasic acids. The polybasic acids may be used each alone, or two or more of them may be used in combination.

For polyvalent alcohol, substances known as monomers for polyester can also be used including, for example: aliphatic polyvalent alcohols such as ethylene glycol, propylene glycol, butenediol, hexanediol, neopentyl glycol, and glycerin; alicyclic polyvalent alcohols such as cyclohexanediol, cyclohexanedimethanol, and hydrogenated bisphenol A; and aromatic diols such as ethylene oxide adduct of bisphenol A and propylene oxide adduct of bisphenol A. The polyvalent alcohols may be used each alone, or two or more of them may be used in combination.

The polybasic acid and the polyvalent alcohol can undergo polycondensation reaction in an ordinary manner, that is, for example, the polybasic acid and the polyvalent alcohol are brought into contact with each other in the presence or absence of the organic solvent and in the presence of the polycondensation catalyst. The polycondensation reaction ends when an acid number, a softening temperature, and the like of the polyester to be produced reach predetermined values. The polyester is thus obtained. When the methyl-esterified compound of the polybasic acid is used as part of the polybasic acid, demethanol polycondensation reaction is caused. In the polycondensation reaction, a compounding ratio, a reaction rate, and the like of the polybasic acid and the polyvalent alcohol are appropriately modified, thereby being capable of, for example, adjusting a content of a carboxyl end group in the polyester and thus allowing for denaturation of the polyester. The denatured polyester can be obtained also by simply introducing a carboxyl group to a main chain of the polyester with use of trimellitic anhydride as polybasic acid. Note that polyester self-dispersible in water may also be used which polyester has a main chain or side chain bonded to a hydrophilic radical such as a carboxyl group or a sulfonate group. Further, polyester may be grafted with acrylic resin.

It is preferred that the binder resin has a glass transition temperature of 30° C. or higher and 80° C. or lower. The binder resin having a glass transition temperature lower than 30° C. easily causes the blocking that the toner thermally aggregates inside the image forming apparatus, which may decrease preservation stability. The binder resin having a glass transition temperature higher than 80° C. lowers the fixing property of the toner onto a recording medium, which may cause a fixing failure.

As the colorant, it is possible to use an organic dye, an organic pigment, an inorganic dye, an inorganic pigment or the like which is customarily used in the electrophotographic field.

Examples of black colorant include carbon black, copper oxide, manganese dioxide, aniline black, activated carbon, non-magnetic ferrite, magnetic ferrite, and magnetite.

Examples of yellow colorant include chrome yellow, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NCG, tart0razine lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138, C.I. pigment yellow 180, and C.I. pigment yellow 185.

Examples of orange colorant include red chrome yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43.

Examples of red colorant include red iron oxide, cadmium red, red lead, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

Examples of purple colorant include manganese purple, fast violet B, and methyl violet lake.

Examples of blue colorant include Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60.

Examples of green colorant include chromium green, chromium oxide, pigment green B, malachite green lake, final yellow green G, and C.I. pigment green 7.

Examples of white colorant include those compounds such as zinc oxide, titanium oxide, antimony white, and zinc sulfide.

The colorants may be used each alone, or two or more of the colorants of different colors may be used in combination. Further, two or more of the colorants with the same color may be used in combination. A usage of the colorant is not limited to a particular amount, and preferably 5 parts by weight to 20 parts by weight, and more preferably 5 parts by weight to 10 parts by weight based on 100 parts by weight of the binder resin.

The colorant may be used as a masterbatch to be dispersed uniformly in the binder resin. Further, two or more kinds of the colorants may be formed into a composite particle. The composite particle is capable of being manufactured, for example, by adding an appropriate amount of water, lower alcohol and the like to two or more kinds of colorants and granulating the mixture by a general granulating machine such as a high-speed mill, followed by drying. The masterbatch and the composite particle are mixed into the toner composition at the time of dry-mixing.

The toner base particle may contain a charge control agent in addition to the binder resin and the colorant. For the charge control agent, charge control agents commonly used in this field for controlling a positive charge and for controlling a negative charge are usable.

Examples of the charge control agent for controlling a positive charge include a basic dye, a quaternary ammonium salt, a quaternary phosphonium salt, an aminopyrine, a pyrimidine compound, a polynuclear polyamino compound, an aminosilane, a nigrosine dye, a derivative thereof, a triphenylmethane derivative, a guanidine salt and an amidin salt.

Examples of the charge control agent for controlling a negative charge include an oil-soluble dye such as an oil black and a spirone black, a metal-containing azo compound, an azo complex dye, a naphthene acid metal salt, a metal complex or metal salt (the metal is a chrome, a zinc, a zirconium or the like) of a salicylic acid or of a derivative thereof, a boron compound, a fatty acid soap, a long-chain alkylcarboxylic acid salt and a resin acid soap. The charge control agents may be used each alone, or optionally two or more of them may be used in combination. Although the amount of the charge control agent to be used is not particularly limited and can be properly selected from a wide range, 0.5 parts by weight or more and 3 parts by weight or less is preferably used relative to 100 parts by weight of the binder resin.

Further, the toner base particle may contain a release agent in addition to the binder resin and the colorant. As the release agent, it is possible to use ingredients which are customarily used in the relevant field, including, for example, petroleum wax such as paraffin wax and derivatives thereof, and microcrystalline wax and derivatives thereof; hydrocarbon-based synthetic wax such as Fischer-Tropsch wax and derivatives thereof, polyolefin wax (e.g. polyethylene wax and polypropylene wax) and derivatives thereof, low-molecular-weight polypropylene wax and derivatives thereof, and polyolefinic polymer wax (low-molecular-weight polyethylene wax, and the like) and derivatives thereof; vegetable wax such as carnauba wax and derivatives thereof, rice wax and derivatives thereof, candelilla wax and derivatives thereof, and haze wax; animal wax such as bees wax and spermaceti wax; fat and oil-based synthetic wax such as fatty acid amides and phenolic fatty acid esters; long-chain carboxylic acids and derivatives thereof; long-chain alcohols and derivatives thereof; silicone polymers; and higher fatty acids.

Note that examples of the derivatives include oxides, block copolymers of a vinylic monomer and wax, and graft-modified derivatives of a vinylic monomer and wax. A usage of the wax may be appropriately selected from a wide range without particularly limitation, and preferably 0.2 part by weight to 20 parts by weight, more preferably 0.5 part by weight to 10 parts by weight, and particularly preferably 1.0 part by weight to 8.0 parts by weight based on 100 parts by weight of the binder resin.

<Toner Base Particle>

The toner base particles obtained at the toner base particle producing step S1 preferably have a volume average particle size of 4 μm or more and 8 μm or less. In a case where the volume average particle size of the toner base particles is 4 μm or more and 8 μm or less, it is possible to stably form a high-definition image for a long time. Moreover, by reducing the particle size to this range, a high image density is obtained even with a small amount of adhesion, which generates an effect capable of reducing an amount of toner consumption. In a case where the volume average particle size of the toner base particles is less than 4 μm, the particle size of the toner base particles becomes too small and high charging and low fluidity are likely to occur. When the high charging and the low fluidity occur, a toner is unable to be stably supplied to a photoreceptor and a background fog and image density decrease are likely to occur. In a case where the volume average particle size of the toner base particles exceeds 8 μm, the particle size of the toner base particles becomes large and the layer thickness of a formed image is increased so that an image with remarkable granularity is generated and the high-definition image is not obtainable, which is undesirable. In addition, as the particle size of the toner base particles is increased, a specific surface area is reduced, resulting in decrease in a charge amount of the toner. When the charge amount of the toner is reduced, the toner is not stably supplied to the photoreceptor and pollution inside the apparatus due to toner scattering is likely to occur.

(2) Fine Resin Particle Preparing Step S2

In the fine resin particle preparing step S2, dried fine resin particles are prepared. The fine resin particles are used as a material for forming a film on the surface of the toner base particle in the subsequent coating step S3. By using the fine resin particles as a material for forming a film on the surface of the toner base particle, occurrence of aggregation due to melting of a low melting component such as a release agent contained in the toner base particles can be prevented during storage.

<Method of Preparing Fine Resin Particles>

The fine resin particles as described above can be obtained, for example, in a manner that raw materials of the fine resin particles are emulsified and dispersed into fine grains by using a homogenizer or the like machine. Further, the fine resin particles can also be obtained by polymerizing monomers.

The drying method of the fine resin particles may use any methods. For example, dried fine resin particles can be obtained using a method such as hot-air receiving drying, conductive heat-transfer drying, far infrared drying or microwave drying.

<Raw Material of Fine Resin Particle>

For the resin used for a raw material of the fine resin particle, a resin used for material of a toner is usable and examples thereof include a polyester, an acrylic resin, a styrene resin, and a styrene-acrylic copolymer. Among the resins exemplified above, the fine resin particle preferably contains an acrylic resin and a styrene-acrylic copolymer. The acrylic resin and the styrene-acrylic copolymer have many advantages such that the strength is high with light weight, transparency is high, the price is low, and materials having a uniform particle size are easily obtained.

Although the resin used for the raw material of the fine resin particle may be the same kind of resin as the binder resin contained in the toner base particle or may be a different kind of resin, the different kind of resin is preferably used in view of performing the surface modification of the toner. When the different kind of resin is used as the resin used for the raw material of the fine resin particle, a softening temperature of the resin used for the raw material of the fine resin particle is preferably higher than a softening temperature of the binder resin contained in the toner base particle. This makes it possible to prevent toners manufactured with the manufacturing method of this embodiment from being fused each other during storage and to improve storage stability. Further, the softening temperature of the resin used for the raw material of the fine resin particle depends on an image forming apparatus in which the toner is used, but is preferably 80° C. or higher and 140° C. or lower. By using the resin in such a temperature range, it is possible to obtain the toner having both the storage stability and the fixing performance.

By using the fine resin particles as the coating material, for example, when a liquid having the fine resin particles dispersed therein is sprayed to the toner base particles and the surface of the toner base particle is coated with the liquid, shape of the fine resin particles remains on the surface of the toner base particle. As a result, a toner having excellent cleanability can be obtained as compared with a toner having smooth surface. Such fine resin particles can be obtained by emulsion dispersing fine resin particle raw material with a homogenizer or the like, thereby forming fine particles. Furthermore, the fine resin particles can be obtained by polymerization of a monomer.

<Fine Resin Particle>

The volume average particle size of the fine resin particles needs to be sufficiently smaller than the average particle size of the toner base particles, and is preferably 0.05 μm or more and 1 μm or less. More preferably, the volume average particle size of the fine resin particles is 0.1 μm or more and 0.5 μm or less. In a case where the volume average particle size of the fine resin particles is 0.05 μm or more and 1 μm or less, a projection with a suitable size is formed on the surface of the coating layer. Whereby, the toner manufactured with the manufacturing method of this embodiment is easily caught by cleaning blades at the time of cleaning, resulting in improvement of the cleaning property.

(3) Pre-mixing Step S3

Figure 2:
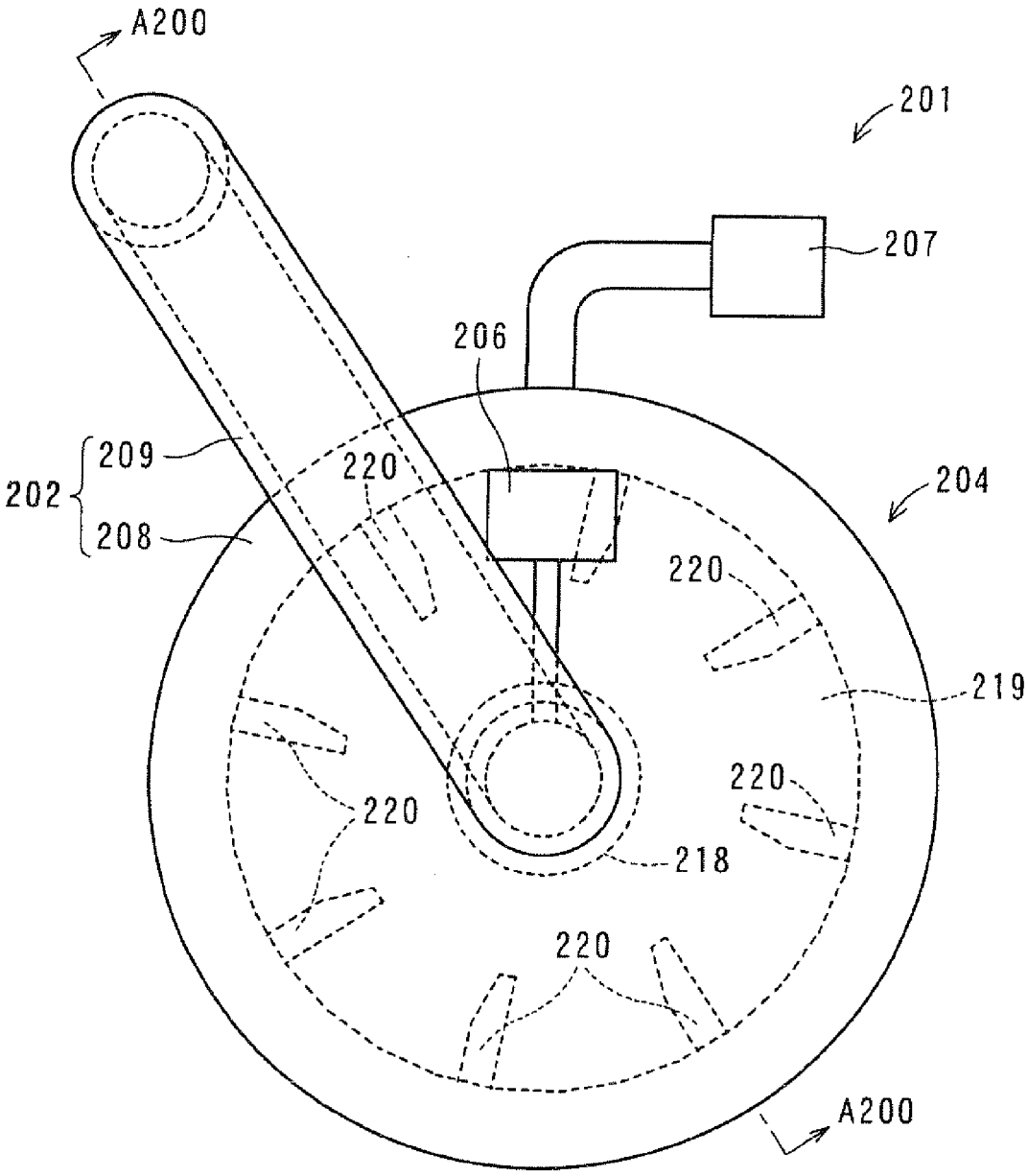
FIG. 2 is a front view of a configuration of a rotary stirring section used for the method for manufacturing a toner according to the first embodiment of the invention.

In the pre-mixing step S3, for example, an apparatus shown in FIG. 2 is used, a secondary aggregate of the fine resin particles is disaggregated by impact force due to circulation of the apparatus and stirring, and the disaggregated fine resin particles are adhered and fixed to the surface of the toner base particle. Thus, a fine resin particle-fixed toner is obtained.

<Rotary Stirring Apparatus>

Figure 3:
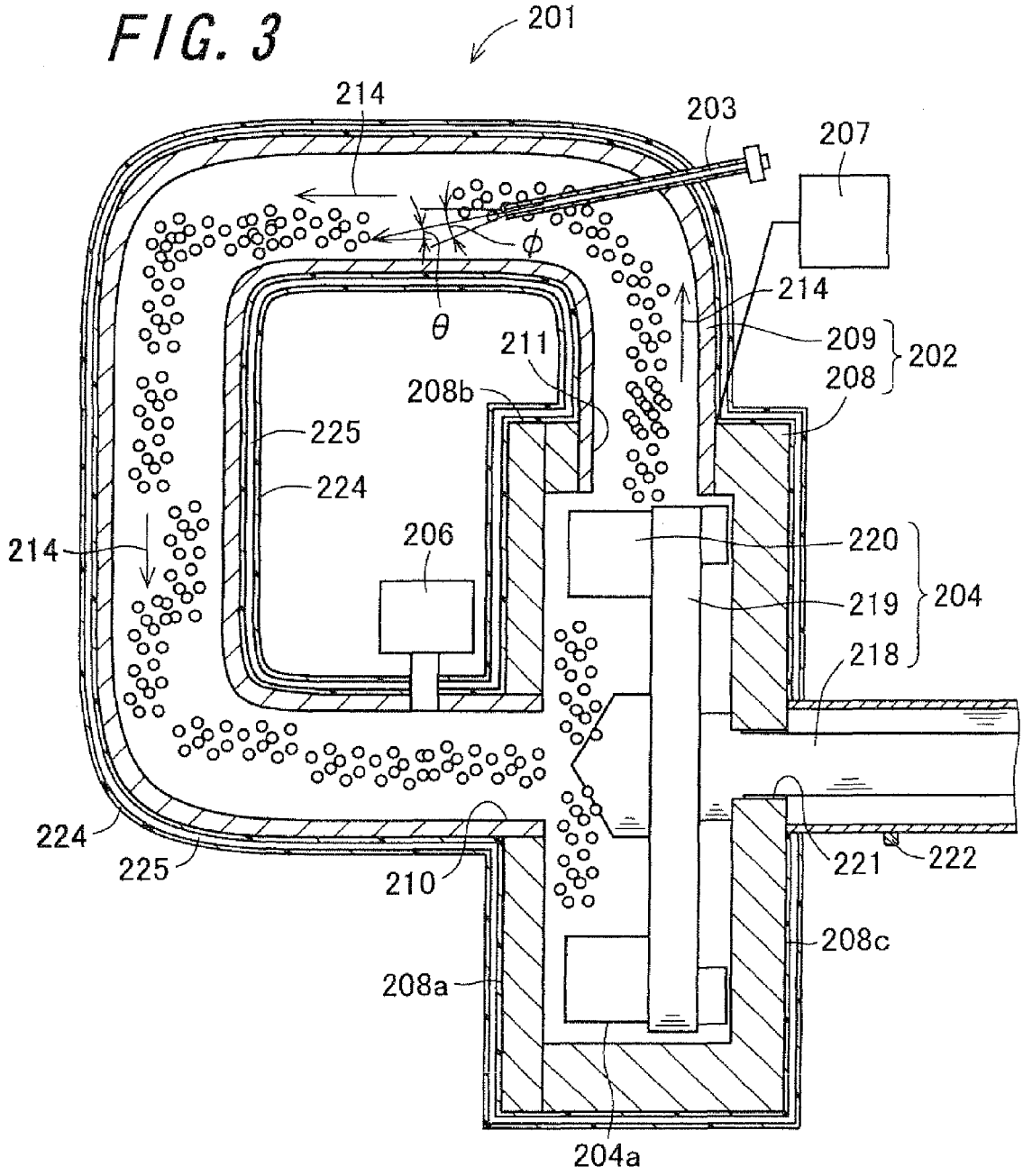
FIG. 3 is a schematic sectional view of the rotary stirring section shown in FIG. 2 taken along the cross-sectional line A200-A200.

FIG. 2 is a front view of a configuration of a rotary stirring apparatus 201 used for the method for manufacturing a toner according to the first embodiment of the invention. FIG. 3 is a schematic sectional view of the rotary stirring apparatus 201 for toner shown in FIG. 2 taken along the cross-sectional line A200-A200. A rotary stirring apparatus 201 is constituted inclusive of a powder passage 202, a spraying section 203, a rotary stirring section 204, a temperature regulation jacket (not shown), a powder inputting section 206, and a powder recovery section 207.

The powder passage 202 is comprised of a rotary stirring chamber 208 and a circulation tube 209. The rotary stirring chamber 208 is a substantially columnar container-shaped member having an inner space. Opening sections 210 and 211 are formed in the rotary stirring chamber 208. The opening section 210 is formed so as to penetrate a side wall including a face 208*a* of the rotary stirring chamber 208 in a thickness direction in a substantially central portion of the face 208 at one side of an axis direction of the rotary stirring chamber 208. The opening section 211 is formed so as to penetrate a side wall including a side face 208*b* of the rotary stirring chamber 208 in a thickness direction in the side face 208*b* vertical to the face 208*a* at one side of the axis direction of the rotary stirring chamber 208. In the circulation tube 209, one end thereof is connected to the opening section 201 and other end thereof is connected to the opening section 211. By so doing, the inner space of the rotary stirring chamber 208 is in communication with the inner space of the circulation tube 209, and the powder passage 202 is formed. In the pre-mixing step, the toner base particles, the fine resin particles and a gas pass through the powder passage 202. The powder inputting section 206 and the powder recovery section 207 are connected to the circulation tube 209 of the powder passage 202.

Figure 4:
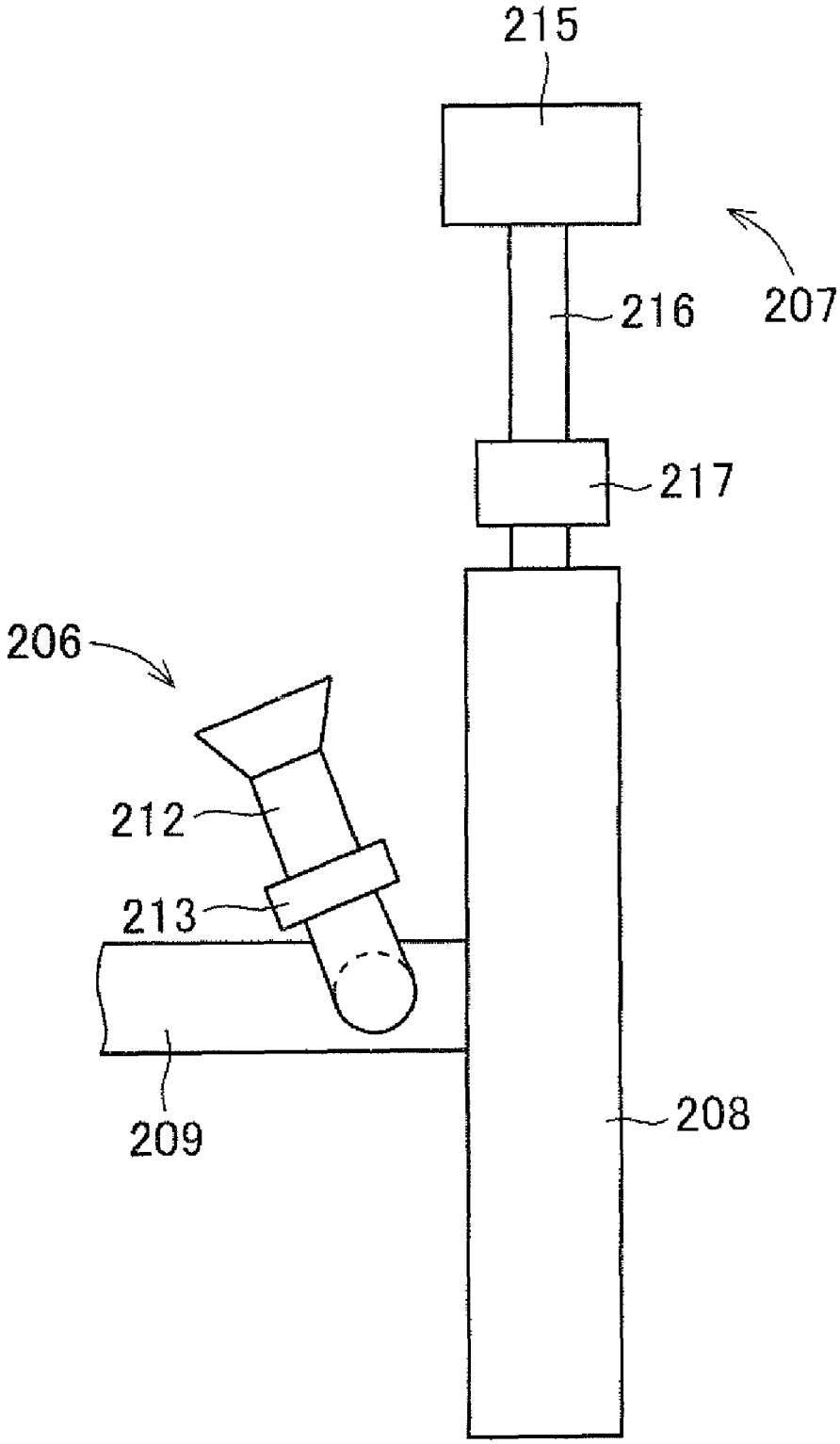
FIG. 4 is a front view of a configuration around the powder inputting section and the powder recovery section.

FIG. 4 is a front view of a configuration around the powder inputting section 206 and the powder recovery section 207. The powder inputting section 206 includes a hopper (not shown) that supplies the toner base particles and the fine resin particles, a supplying tube 212 that communicates the hopper and the powder passage 202, and an electromagnetic valve 213 provided in the supplying tube 212. The toner base particles and the fine resin particles supplied from the hopper are supplied to the powder passage 202 through the supplying tube 212 in a state where the passage in the supplying tube 212 is opened by the electromagnetic valve 213. The toner base particles and the fine resin particles supplied to the powder passage 202 flow in the constant powder flowing direction with stirring by the rotary stirring section 204. Moreover, the toner base particles and the fine resin particles are not supplied to the powder passage 202 in a state where the passage in the supplying tube 212 is closed by the electromagnetic valve 213. The powder recovery section 207 includes a recovery tank 215, a recovery tube 216 that communicates the recovery tank 215 and the powder passage 202, and an electromagnetic valve 217 provided in the recovery tube 216. The toner particles flowing through the powder passage 202 are recovered in the recovery tank 215 through the recovery tube 216 in a state where the passage in the recovery tube 216 is opened by the electromagnetic valve 217. Moreover, the toner particles flowing through the powder passage 202 are not recovered in a state where the passage in the recovery tube 216 is closed by the electromagnetic valve 217.

The rotary stirring section 204 includes a rotary shaft 218, a discotic rotary disc 219, and a plurality of stirring blades 220. The rotary shaft 218 is a cylindrical-bar-shaped member rotating around the axis line by a motor not shown in a rotary shaft driving portion (not shown) which is a portion for driving the rotary shaft 218. The rotary shaft 218 is a cylindrical-bar-shaped member which has an axis matching an axis of the rotary stirring chamber 208, is provided on a surface 208*c* at other side in an axial direction of the rotary stirring chamber 208 so as to be inserted in a through-hole 221 formed so as to penetrate a side wall including the surface 208*c* in a thickness direction, and rotates around the axis by a motor not shown. The rotary disc 219 is a discotic member which is supported by the rotary shaft 218 such that its axis matches the axis of the rotary shaft 218 and rotates together with the rotation of the rotary shaft 218. The plurality of stirring blades 220 are supported by the rotary disc 219 and rotate together with the rotation of the rotary disc 219.

Rotating speed of the rotary stirring section 204 is set such that peripheral speed in the outermost periphery is 50 m/sec or more. The outermost periphery of the rotary stirring section 204 is a portion of the rotary stirring section 204 in which a distance to the axis of the rotary shaft 218 is longest in a direction perpendicular to a direction to which the rotary shaft 218 of the rotary stirring section 204 extends. When the peripheral speed at the outermost periphery is 50 m/sec or more, fluidizing the toner base particles and the fine resin particles in an isolated state and reducing frequency of collision of the toner base particles and the fine resin particles with the inner wall of the powder passage can simultaneously be achieved. Where the peripheral speed at the outermost periphery is less than 50 m/sec, the toner base particles and the fine resin particles cannot be fluidized in an isolated state. As a result, a coating cannot be formed on the toner base particles.

To stably disaggregate the secondary aggregate of the fine resin particles in the pre-mixing step, it is necessary to suppress softening of the fine resin particles by the increase in temperature in the powder passage 202 due to circulation and stirring of the toner base particles and the fine resin particles. For this reason, the temperature in the powder passage 202 of the fine resin particles is preferably set to a temperature lower than a glass transition temperature of the fine resin particles. In addition, the temperature in the powder passage 202 of the fine resin particles is preferably set to a temperature lower than a glass transition temperature of the toner base particles. By so doing, aggregation of the toner base particles with each other can be suppressed, and uniform coating of the fine resin particle and prevention of adhesion of the fine resin particles to the inner wall of the powder passage can be achieved. To achieve this, it is necessary to arrange a temperature regulation jacket 224 having an inner diameter larger than an outer diameter of the powder passage tube and the rotary stirring section in at least a part of the outer side of the powder passage tube and the rotary stirring section in order to maintain the temperature of the powder passage 202 and the rotary stirring section 204 at temperature lower than the glass transition temperature of the toner base particles and the fine resin particles, thereby providing an apparatus having a function of regulating temperature by passing a cooling medium or a heating medium through the space.

The temperature regulation jacket 224 which is a temperature regulation section is provided in at least a part of the inner wall of the powder passage 202. The temperature regulation jacket 224 regulates the inner wall temperature of the powder passage 202 to a constant temperature by flowing a medium such as water in a passage 225 formed therein, and prevents adhesion of the toner base particles. The temperature regulation jacket 224 is preferably provided at the outer side of the part of the powder passage 202 to which the toner base particles are easily adhered. In the present embodiment, the temperature regulation jacket 224 is provided in at least the whole circulation tube 209 in the powder passage 202, the rotary stirring chamber 208 and the inner wall of the rotary stirring chamber.

The spraying section 203 will be described in the coating step described hereinafter.

<Preparation of Fine Resin Particle-Fixed Toner>

Returning to FIG. 1, the pre-mixing step S3 using the rotary stirring apparatus includes a first temperature regulation step S3*a*, a first powder inputting step S3*b*, a fine resin particle disaggregating step S3*c*, a fine resin particle fixation step S3*d*, and a first powder recovery step S3*e*. First of all, as the first temperature regulation step S3*a*, the temperature of the inner wall of the powder passage 202 is regulated to a constant temperature by the temperature regulation jacket 224. Next, as the first powder inputting step S3*b*, the toner base particles and the fine resin particles are fed to the powder passage 202 from the powder inputting section 206 in a state where the rotary shaft 218 of the rotary stirring section 204 rotates. In the present step, the peripheral speed of the outermost periphery of the rotary stirring section 204 is set to 50 m/sec or more. The toner base particles and the fine resin particles fed to the powder passage 202 are stirred by the rotary stirring section 204, and pass through the circulation tube 209 of the powder passage 202 in an arrow direction 214. As the fine resin particle disaggregating step S3*c* and the fine resin particle fixation step S3*d*, the secondary aggregate of the fine resin particles is disaggregated to a particle size about 1 to 10 times of a primary particle size in the rotary stirring chamber 208 of the powder passage 202. The disaggregated fine resin particles are adhered and fixed to the surface of the toner base particle in the powder passage 202 without re-aggregation. When the fine resin particles are fixed to the surface of the toner base particle and flow speed of a powder is stabilized, as the powder recovery step S3*e*, rotation of the rotary stirring section 204 is stopped, and a fine resin particle-fixed toner is recovered from the powder recovery section 207.

The fine resin particles are in an aggregated state before mixing with the toner base particles. When a liquid having a plasticizing effect is sprayed to the toner base particles and the fine resin particles without disaggregating an aggregate of the fine resin particles and a film of the fine resin particles is formed, the aggregated fine resin particles are adhered and fixed to the surface of the toner base particle. As a result, a film having a non-uniform film thickness is formed. By conducting the pre-mixing step, that is, by conducting a disaggregating treatment of the fine resin particles in a liquid unsprayed state as the pre-step of film forming by liquid spraying, the fine resin particles can be fixed to the surface of the toner base particle in a state where an aggregate is disaggregated, and spreading treatment of the fine resin particles by liquid spraying is conducted in this state. As a result, a film having a uniform film thickness, having high uniformity and free of exposure of the toner base particles can be formed.

Rapid temperature increase, inducing softening of the fine resin particles which prevents disaggregation, can be suppressed by conducting the first temperature regulation step S3*a*. Furthermore, this can prevent the disadvantage that the toner base particles and the fine resin particles in a fluidized state store heat and soften by collision with the rotary stirring section 204 and the inner wall of the powder passage, and fix to the rotary stirring section 204 and the inner wall of the powder passage. As a result, the yield of the fine resin particle-fixed toner is improved.

It is preferred in the first temperature regulation step to regulate the temperature in the powder passage to 55° C. or lower. By so doing, the fine resin particles can sufficiently be disaggregated, and after disaggregation, the fine resin particles can be adhered and fixed to the surface of the toner base particle by utilizing temperature increase due to stirring of the toner base particles and the fine resin particles. As a result, a film can further be uniformed. Furthermore, fixation to the rotary stirring section 204 and the inside of the powder passage can be prevented. As a result, the yield of a fine resin particle-fixed toner can further be improved.

(4) Coating Step S4

In the coating step S4, for example, by using the rotary stirring apparatus 201 described above and spraying a liquid having the effect of plasticizing the toner base particles and the fine resin particles to the fine resin particle-fixed toner in a fluidized state obtained by the pre-mixing step in the spraying section 203, the fine resin particles are spread on the surface of the toner base particle. Thus, a film of the fine resin particles is formed.

As shown in FIG. 3, the spraying section 203 is provided in a powder passage at the nearest side to the opening section 211 in a flowing direction of the fine resin particle-fixed toner in the circulation tube 209 of the powder passage 202. The spraying section 203 comprises a liquid reservoir which reserves a liquid, a carrier gas supplying section which supplies a carrier gas, and a two-fluid nozzle which mixes a liquid and a carrier gas, sprays the mixture obtained toward the fine resin particle-fixed toner present in the powder passage 202, and sprays droplets of the liquid to the fine resin particle-fixed toner. The carrier gas can use compressed air and the like.

In the present embodiment, the two-fluid nozzle of the spraying section 203 is inserted in an opening formed in an outer wall of the powder passage 202, and is provided in parallel toward inside the powder passage 202 to a powder flowing direction which is a direction that the fine resin particle-fixed toner fluidizes in the powder passage 202. By so doing, a liquid spraying direction from the spraying section 203 is the same direction as the powder flowing direction. The liquid flowing direction is a direction of an axis line of the two-fluid nozzle. An angle θ between the liquid spraying direction from the spraying section 203 and the powder flowing direction is preferably 0° to 45°. When the θ falls within this range, droplets of a liquid is prevented from being rebounded on the inner wall of the powder passage 202, and the yield of the toner base particles having a film formed thereon can further be improved. Where the angle θ between the liquid spraying direction from the spraying section 203 and the powder flowing direction exceeds 45°, droplets of a liquid are easily rebounded on the inner wall of the powder passage 202, and the liquid easily remains therein. As a result, aggregation of the fine resin particle-fixed toner is generated and the yield is deteriorated.

Further, a spreading angle Φ sprayed by the two-fluid nozzle is preferably 20° or more and 90° or less. In a case where the spreading angle Φ falls out of this range, it is likely to be difficult to spray the liquid uniformly to the toner base particles.

The liquid having an effect of plasticizing the toner base particles and the fine resin particles without dissolving is not particularly limited, but is preferably a liquid that is easily vaporized since the liquid needs to be removed from the toner base particles and the fine resin particles after the liquid is sprayed. An example of the liquid includes a liquid including lower alcohol. Examples of the lower alcohol include methanol, ethanol, and propanol. In a case where the liquid includes such lower alcohol, it is possible to enhance wettability of the fine resin particles as a coating material with respect to the toner base particles and adhesion, deformation and film-forming of the fine resin particles are easily performed over the entire surface or a large part of the toner base particles. Further, since the lower alcohol has a high vapor pressure, it is possible to further shorten the drying time at the time of removing the liquid and to suppress aggregation of the toner base particles.

Concentration of the liquid sprayed by the spraying section 203 is preferably about 3% or lower in a concentration sensor at a discharge part to outside an apparatus. When the concentration of the liquid sprayed by the spraying section 203 falls within this range, drying speed of the liquid can sufficiently be increased. As a result, the fine resin particle-fixed toner in which undried liquid remains can be prevented from being adhered to other fine resin particle-fixed toner, and aggregation of the fine resin particle-fixed toner can be prevented. The concentration of the liquid sprayed by the spraying section 203 is further preferably 0.1% to 3.0% in the concentration sensor. When the concentration of the liquid sprayed falls within this range, aggregation of the fine resin particle-fixed toner can be prevented without decreasing productivity.

In addition, the sprayed liquid is preferably exhausted to outside the system from a gas exhausting section 222. By exhausting the liquid sprayed in the apparatus to outside the system, drying speed of the liquid is increased. As a result, toner particles in which undried liquid remains can be prevented from being adhered to other toner particles, and aggregation of toner particles can be prevented.

Viscosity of the liquid sprayed by the spraying section 203 is preferably 5 cP or lower. The viscosity of the liquid is measured at 25° C. The viscosity of the liquid can be measured with, for example, a corn-plate type rotation viscometer.

A preferable example of the liquid having the viscosity of 5cP or less includes alcohol. Examples of the alcohol include methyl alcohol and ethyl alcohol. These alcohols have the low viscosity and are easily vaporized, and therefore, when the liquid includes the alcohol, it is possible to spray the liquid with a minute droplet diameter without coarsening a diameter of the spray droplet of the liquid to be sprayed from the spraying section 203. It is also possible to spray the liquid with a uniform droplet diameter. It is possible to further promote fining of the droplet at the time of collision of the toner base particles and the droplet. This makes it possible to obtain a coated toner having excellent uniformity by uniformly wetting the surfaces of the toner base particles and the fine resin particles with the liquid and applying the liquid to the surfaces of the toner base particles and the fine resin particles, and softening the fine resin particles by a multiplier effect with collision energy.

In the inside of the circulation tube 209 downstream of the spraying section 203, the sprayed liquid is not dried and is retained, and the drying speed is made slow with an improper temperature and the liquid is easily retained, and when the toner base particles are in contact therewith, the toner base particles are easily adhered to the inner wall of the powder passage 202. This may be an aggregation generation source of the toner base particles. In the inner wall near the opening section 210, the toner base particles that flow in the circulation tube 209 and flow into the stirring section 208 from the opening section 210 easily collide with the toner base particles that flow in the rotary stirring chamber 208 with stirring of the rotary stirring section 204. Whereby, the collided toner base particles are easily adhered to the vicinity of the opening section 210. Accordingly, by providing the temperature regulation jacket 224 in such a part where the toner base particles are easily adhered, it is possible to prevent the toner base particles from being adhered to the inner wall of the powder passage 202 more reliably.

In the present step, peripheral speed at the outermost periphery 204*a* of the rotary stirring section 204 is 50 m/sec or more. The temperature regulation jacket 224 which prevents adhesion of the fine resin particle-fixed toner to the inner wall of the powder passage 202 is provided in at least a part of the inner wall of the powder passage 202 and the wall surface of the rotary stirring chamber.

<Formation of Film>

Returning to FIG. 1, the coating step S4 includes a second temperature regulation step S4*a*, a second powder inputting step S4*b*, a spraying step S4*c*, a film-forming step S4*d*, a drying step S4*e*, and a second powder recovery step S4*f*. As the second temperature regulation step S4*a*, the temperature of the inner wall of the powder passage 202 is regulated to a constant temperature by the temperature regulation jacket 224. As the second powder inputting step S4*b*, the fine resin particle-fixed toner in which the fine resin particles are fixed to the surface of the toner base particle are fed to the powder passage 202 from the powder inputting section 206 in a state where the rotary shaft 218 of the rotary stirring section 204 rotates. When flow speed of a powder in the powder passage 202 is stabilized, as the spraying step S4*c*, spraying of a liquid from the spraying section 203 is initiated. The liquid is sprayed to the fine resin particle-fixed toner from the spraying section 203 in a state of flowing in the circulation tube 209 of the powder passage 202, and the sprayed liquid is spread on the surface of the fine resin particle-fixed toner. By so doing, the fine resin particle-fixed toner is plasticized, and by applying thermal energy due to stirring, as the film-forming step S4*d*, the fine resin particles are softened to form a continuous film. After completion of liquid spraying necessary for film formation, spraying of a liquid from the spraying section is completed, and as the drying step S4*e*, a liquid remaining on the surface of a powder is evaporated, and discharged to outside the system through a through-hole 221. After passing the drying step for a predetermined time, as the second powder recovery step S4*f*, rotation of the rotary stirring section 204 is stopped, and a toner is recovered from the powder recovery section 207.

As described above, the peripheral speed at the outermost periphery 204*a* of the rotary stirring section 204 is 50 m/sec or more. Because the peripheral speed at the outermost periphery of the rotary stirring section 204 is 50 m/sec or more, this can simultaneously achieve that the fine resin particle-fixed toner is fluidized in an isolated state and that liquid concentration in an apparatus can be maintained constant, thereby reducing aggregation of the fine resin particle-fixed toner.

Conducting temperature regulation in the coating step can prevent the disadvantage that the fine resin Particle-fixed toner in a fluidized state stores heat and softens by collision with the rotary stirring section 204 and the inner wall of the powder passage 202, and is adhered to the rotary stirring section 204 and the inner wall of the powder passage 202. Therefore, aggregation and growth of other toner particles and fine resin particles by acting the adhered fine resin particle-fixed toner as a nucleus can be suppressed, and narrowing the passage for fluidizing the fine resin particle-fixed toner by aggregation can be prevented. As a result, the yield toner can be improved.

The temperature in the powder passage 202 is substantially uniform in any portion in the powder passage 202 by the flowing of the fine resin particle-fixed toner. It is preferred in the second temperature regulation step to regulate the temperature in the powder passage to 50° C. or higher and 55° C. or lower. By so doing, spreading treatment of the fine resin particles is sufficiently conducted, and a film is further uniformed. Furthermore, aggregation in the rotary stirring section and the powder passage can be prevented. As a result, the yield of a toner can further be improved. Where the temperature in the powder passage 202 exceeds 55° C., the toner particles are excessively softened in the powder passage 202, and aggregation between toners may be generated. Where the temperature in the powder passage 202 is lower than 50° C., drying speed of a dispersion becomes slow, and productivity may be deteriorated. Therefore, to prevent aggregation between toners, an apparatus in which the temperature regulation jacket 224 having an inner diameter larger than an outer diameter of the powder passage is arranged in at least the outside of the powder passage, thereby imparting the function to regulate temperature by passing a cooling medium or a heating medium through the space is provided in order to maintain the temperature of the powder passage 202 and the rotary stirring section at a temperature lower than a glass transition temperature of the toner base particles and the fine resin particles.

In the present embodiment, a pre-mixing stabilization temperature which is a temperature in the powder passage 202, elevated and stabilized from the initiation point of the pre-mixing step in the pre-mixing step S3 is lower than a coating stabilization temperature which is a temperature in the powder passage 202, elevated and stabilized from the initiation point of the coating step in the coating step S4. By so doing, the fine resin particles are fixed to the surface of the toner base particle in a small exposure state in the pre-mixing step S3. In the coating step S4, spreading treatment of the fine resin particles is conducted in a stable manner, and a film having less irregularity on the surface and having a uniform film thickness can be formed.

In the same time in the elapsed time from the initiation of the respective pre-mixing step S3 and coating step S4, the temperature in the powder passage 202 in the pre-mixing step is preferably always lower than the temperature in the powder passage 202 in the coating step. This can suppress the fine resin particles from softening in the pre-mixing step S3, and can sufficiently disaggregate the secondary aggregate of the fine resin particles. As a result, the disaggregated fine resin particles can uniformly be adhered to the surface of the toner base particle. Then, in the coating step S4, spreading treatment of the fine resin particles uniformly adhered to the surface of the toner base particle can stably be conducted. Therefore, a toner having good coating uniformity can be obtained.

Thus, the production method of a toner according to the invention can suppress that other toner particles and fine resin particles are aggregated and grown by acting the adhered fine particle-fixed toner as a nucleus, and can prevent that the passage for fluidizing the fine resin particle-fixed toner is narrowed by aggregation. As a result, the yield of a toner can be improved.

In the present embodiment, the same apparatus is used as treatment apparatuses conducting the pre-mixing step S3 and the coating step S4. By so doing, capital investment is inexpensive and the space of installation site can be saved.

The configuration of such a rotary stirring apparatus 201 is not limited to the above and various alterations may be added thereto. For example, in the present embodiment, the temperature regulation jacket 224 is provided over the powder passage 202 and an entire wall surface of the rotary stirring section 204, but not limited to this configuration, it may be provided in a part of the powder passage 202 or the wall surface of the rotary stirring section 204. In a case where the temperature regulation jacket 224 is provided over the powder passage 202 and the entire wall surface of the rotary stirring section 204, it is possible to prevent the toner base particles from being adhered to the inner wall of the powder passage 202 more reliably.

The rotary stirring apparatus 201 as described above can be also obtained by combining a commercially available stirring apparatus and the spraying section. An example of the commercially available stirring apparatus provided with a powder passage 202 and a rotary stirring section 204 includes Hybridization system (trade name, manufactured by Nara Machinery Co., Ltd.) By installing a liquid spraying section in the stirring apparatus like this, the stirring apparatus is usable as the toner manufacturing apparatus used for the method for manufacturing a toner of the invention.

In another embodiment of the invention, a toner may be manufactured using two rotary stirring apparatuses consisting of a first rotary stirring apparatus and a second rotary stirring apparatus. For example, the first rotary stirring apparatus is used as an apparatus conducting the pre-mixing step S3 and the second rotary stirring apparatus is used an apparatus conducting the coating step S4. In this case, the first rotary stirring apparatus and the second rotary stirring apparatus may be apparatuses having the same structure, and may be apparatuses having different structures. At least one of the first rotary stirring apparatus and the second rotary stirring apparatus may be the rotary stirring apparatus 201 having a structure shown in FIGS. 2 to 4. By so doing, when manufacturing a plurality of toners, a continuous concurrent treatment can be conducted such that the coating step for manufacturing a toner is conducted with the second rotary stirring apparatus, and simultaneously with the coating step, the pre-mixing step for manufacturing a toner different from the toner to which the coating step is conducted is conducted with the first rotary stirring apparatus. When the continuous concurrent treatment is conducted, productivity of a toner per unit time can be improved in the case of manufacturing a plurality of toners as compared with the case that a continuous concurrent treatment is not conducted. Specifically, in the case of manufacturing a toner with the constitution of the present embodiment described hereinafter, productivity of a toner can be improved by about 20% as compared with the case that a continuous concurrent treatment is not conducted.

In still another embodiment, the first powder recovery step S3*e* and the second powder inputting step S4*b* may not be conducted. That is, after the fine resin particle fixation step S3*d*, the rotary stirring section 204 is stopped, the second temperature regulation step S4*a* is conducted while leaving the fine resin particle-fixed toner in the powder passage, the rotary stirring section 204 is rotated at the time when the temperature in the powder passage 202 reaches a predetermined temperature, and the steps after the spraying step S4*c* are conducted. By conducting the second temperature regulation step S4*a* in a state where the rotary stirring section 204 is stopped, the fine resin particles on the surface of the fine resin particle-fixed toner can be prevented from forming a film during temperature regulation. As a result, a good coating can be formed as well as the embodiment of conducting the first powder recovery step S3*e* and the second powder inputting step S4*b*.

2. Toner

A toner according to a second embodiment of the invention is manufactured using the method for manufacturing a toner according to the first embodiment. By so doing, there is obtained a toner in which a coating amount of the coating material with which the toner base particle is coated is uniform and toner characteristics such as chargeability between the individual toner particles are uniform. Further, internal component protection effect due to the film on the surface of the toner base particle is exhibited, making it possible to obtain a toner having strong durability. When an image is formed using such a toner, it is possible to obtain an image having high definition and excellent image quality without unevenness in density.

To the toner of the invention, an external additive may be added. As the external additive, heretofore known substances can be used including silica and titanium oxide. It is preferred that these substances may be surface-treated with silicone resin and a silane coupling agent. A preferable usage of the external additive is 1 part by weight to 10 parts by weight based on 100 parts by weight of the toner.

3. Developer

A developer according to a third embodiment of the invention may be implemented by using the toner of the invention in form of either one-component developer or two-component developer. In the case where the developer is used in form of one-component developer, only the toner is used without carriers. As mentioned above, since the toner of the invention has uniform toner characteristics, it is possible to obtain an image having high definition and excellent image quality without unevenness in density. In the case where the developer is used in form of one-component developer, a blade and a fur brush are used to effect the fictional electrification at a developing sleeve so that the toner is attached onto the sleeve, thereby conveying the toner to perform image formation.

In the case where the developer is used in form of two-component developer, the toner of the invention is used together with a carrier. The toner of the invention has uniform toner characteristics and has stable chargeability because adhesion of the toner to a carrier can be suppressed by the film on the surface of the toner base particle. As a result, it is possible to obtain an image having high definition and excellent image quality without unevenness in density.

As the carrier, heretofore known substances can be used including, for example, single or complex ferrite composed of iron, copper, zinc, nickel, cobalt, manganese, and chromium; a resin-coated carrier having carrier core particles whose surfaces are coated with coating substances; or a resin-dispersion carrier in which magnetic particles are dispersed in resin. As the coating substance, heretofore known substances can be used including polytetrafluoroethylene, a monochloro-trifluoroethylene polymer, polyvinylidene-fluoride, silicone resin, polyester, a metal compound of di-tertiary-butylsalicylic acid, styrene resin, acrylic resin, polyamide, polyvinyl butyral, nigrosine, aminoacrylate resin, basic dyes or lakes thereof, fine silica powder, and fine alumina powder. In addition, the resin used, for the resin-dispersion carrier is not limited to particular resin, and examples thereof include styrene-acrylic resin, polyester resin, fluorine resin, and phenol resin. Both of the coating substance in the resin-coated carrier and the resin used for the resin-dispersion carrier are preferably selected according to the toner components. Those substances and resin listed above may be used each alone, and two or more thereof may be used in combination.

A particle of the carrier preferably has a spherical shape or flattened shape. A particle size of the carrier is not limited to a particular diameter, and in consideration of forming higher-quality images, the particle size of the carrier is preferably 10 μm to 100 μm and more preferably 20 μm to 50 μm. Further, the resistivity of the carrier is preferably $10^8$ Ω·cm or more, and more preferably $10^{12}$ Ω·cm or more. The resistivity of the carrier is obtained as follows. At the outset, the carrier is put in a container having a cross section of 0.50 $cm^2$, thereafter being tapped. Subsequently, a load of 1 $kg/cm^2$ is applied by use of a weight to the carrier particles which are held in the container as just stated. When an electric field of 1,000 V/cm is generated between the weight and a bottom electrode of the container by application of voltage, a current value is read. The current value indicates the resistivity of the carrier. When the resistivity of the carrier is low, electric charges will be injected into the carrier upon application of bias voltage to a developing sleeve, thus causing the carrier particles to be more easily attached to the photoreceptor. In this case, the breakdown of bias voltage is more liable to occur.

Magnetization intensity (maximum magnetization) of the carrier is preferably 10 emu/g to 60 emu/g and more preferably 15 emu/g to 40 emu/g. The magnetization intensity depends on magnetic flux density of a developing roller. Under the condition of ordinary magnetic flux density of the developing roller, however, no magnetic binding force work on the carrier having the magnetization intensity less than 10 emu/g, which may cause the carrier to spatter. The carrier having the magnetization intensity larger than 60 emu/g has bushes which are too large to keep the non-contact state with the image bearing member in the non-contact development or to possibly cause sweeping streaks to appear on a toner image in the contact development.

A use ratio of the toner to the carrier in the two-component developer is not limited to a particular ratio, and the use ratio is appropriately selected according to kinds of the toner and carrier. To take the resin-coated carrier (having density of 5 $g/cm^2$ to 8 $g/cm^2$) as an example, the usage of the toner may be determined such that a content of the toner in the developer is 2% by weight to 30% by weight and preferably 2% by weight to 20% by weight of the total amount of the developer. Further, in the two-component developer, coverage of the carrier with the toner is preferably 40% to 80%.

4. Image Forming Apparatus

Figure 5:
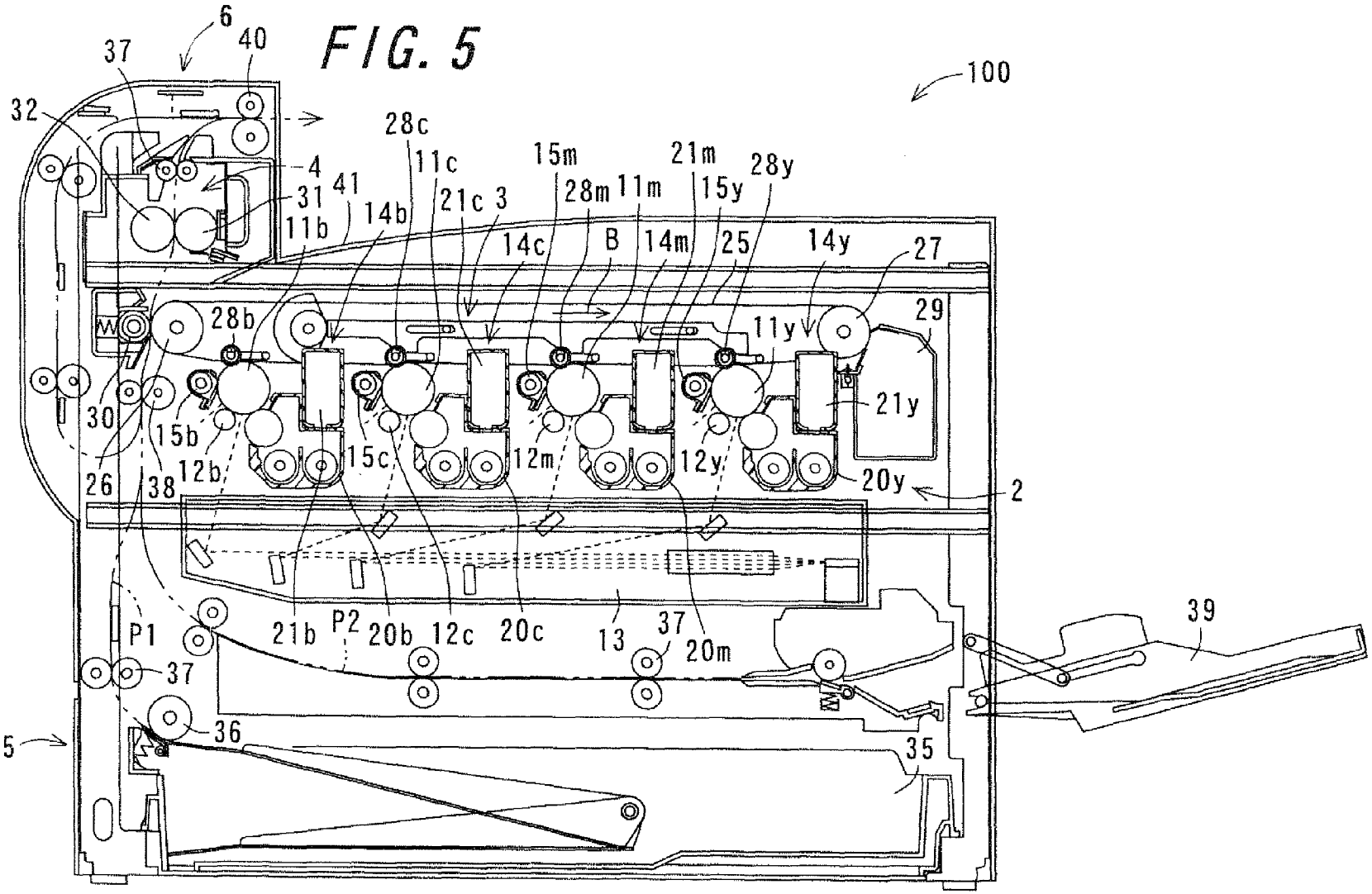
FIG. 5 is a sectional view schematically showing a configuration of an image forming apparatus according to a fourth embodiment of the invention.

FIG. 5 is a sectional view schematically showing a configuration of an image forming apparatus 100 according to a fourth embodiment of the invention. The image forming apparatus 1 is a multifunctional peripheral having a copier function, a printer function, and a facsimile function. In the image forming apparatus 100, according image information transmitted thereto, a full-color or monochrome image is formed on a recording medium. To be specific, three print modes, i.e., a copier mode, a printer mode, and a facsimile mode are available in the image forming apparatus 100, one of which print modes is selected by a control unit (not shown) in response to an operation input given by an operating section (not shown) or a print job given by a personal computer, a mobile computer, an information record storage medium, or an external equipment having a memory unit.

The image forming apparatus 100 includes a photoreceptor drum 11, an image forming section 2, a transfer section 3, a fixing section 4, a recording medium feeding section 5, and a discharging section 6. In accordance with image information of respective colors of black (b), cyan (c), magenta (m), and yellow (y) which are contained in color image information, there are provided respectively four sets of the components constituting the toner image forming section 2 and some parts of the components contained in the transfer section 3. The four sets of respective components provided for the respective colors are distinguished herein by giving alphabets indicating the respective colors to the end of the reference numerals, and in the case where the sets are collectively referred to, only the reference numerals are shown.

The image forming section 2 includes a charging section 12, an exposure unit 13, a developing device 14, and a cleaning unit 15. The charging section 12 and the exposure unit 13 functions as a latent image forming section. The charging section 12, the developing device 14, and the cleaning unit 15 are disposed in the order just stated around the photoreceptor drum 11. The charging section 12 is disposed vertically below the developing device 14 and the cleaning unit 15.

The photoreceptor drum 11 is a roller-like member provided so as to be capable of rotationally driving around an axis by a rotary driving section (not shown) and on the surface of which an electrostatic latent image is formed. The rotary driving section of the photoreceptor drum 11 is controlled by a control unit that is implemented by a central processing unit (CPU). The photoreceptor drum 11 is comprised of a conductive substrate (not shown) and a photosensitive layer formed on the surface of the conductive substrate. The conductive substrate may be various shapes including a cylindrical shape, a columnar shape, or a thin film sheet shape, for example. Among them, the cylindrical shape is preferable. The conductive substrate is formed by a conductive material.

As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film in which a conductive layer containing one or two or more of aluminum, aluminum alloy, tin oxide, gold, indium oxide, etc. is formed on a film-like substrate such as a synthetic resin film, a metal film, and paper; and a resin composition containing conductive particles and/or conductive polymers. As the film-like substrate used for the conductive film, a synthetic resin film is preferred and a polyester film is particularly preferred. Further, as the method of forming the conductive layer in the conductive film, vapor deposition, coating, or the like is preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. When the undercoat layer is provided, the flaws and irregularities present on the surface of the conductive substrate are covered, leading to advantages such that the photosensitive layer has a smooth surface, that chargeability of the photosensitive layer can be prevented from degrading during repetitive use, and that the chargeability of the photosensitive layer can be enhanced under at least either a low temperature circumstance or a low humidity circumstance. Further, a laminated photoreceptor is also applicable which has a highly-durable three-layer structure having a photoreceptor surface-protecting layer provided on the top layer.

The charge generating layer contains as a main substance a charge generating substance that generates charges under irradiation of light, and optionally contains known binder resin, plasticizer, sensitizer, and the like. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generating ability and are suitable for forming a highly-sensitive photosensitive layer. The charge generating substances may be used each alone, or two or more of them may be used in combination. The content of the charge generating substance is not particularly limited, and preferably from 5 parts by weight to 500 parts by weight and more preferably from 10 parts by weight to 200 parts by weight based on 100 parts by weight of the binder resin in the charge generating layer. Also as the binder resin for charge generating layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resin, polyvinyl butyral, polyallylate, polyamide, and polyester. The binder resin may be used each alone or optionally two or more of them may be used in combination.

The charge generating layer can be formed by dissolving or dispersing an appropriate amount of a charge generating substance, binder resin and, optionally, a plasticizer, a sensitizer, etc., respectively in an appropriate organic solvent which is capable of dissolving or dispersing the substances described above, to thereby prepare a coating solution for charge generating layer, and then applying the coating solution for charge generating layer to the surface of the conductive substrate, followed by drying. The thickness of the charge generating layer obtained in this way is not particularly limited, and preferably from 0.05 μm to 5 μm and more preferably from 0.1 μm to 2.5 μm.

The charge transporting layer stacked over the charge generating layer contains as essential substances a charge transporting substance having an ability of receiving and transporting charges generated from the charge generating substance, and binder resin for charge transporting layer, and optionally contains known antioxidant, plasticizer, sensitizer, lubricant, etc. As the charge transporting substance, materials used customarily in the relevant field can be used including, for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an imidazole derivative, 9-(p-diethylaminostyryl) anthracene, 1,1-bis(4-dibenzylaminophenyl)propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiophene derivative, a phenanthrenequinone derivative, an indenopyridine derivative, a thioquisantone derivative, a benzo[c]cinnoline derivative, a phenazine oxide derivative, tetracyanoethylene, tetracyaroquinodimethane, bromanil, chloranil, and benzoquinone. The charge transporting substances may be used each alone, or two or more of them may be used in combination. The content of the charge transporting substance is not particularly limited, and preferably from 10 parts by weight to 300 parts by weight and more preferably from 30 parts by weight to 150 parts by weight based on 100 parts by weight of the binder resin in the charge transporting layer.

As the binder resin for charge transporting layer, it is possible to use materials which are used customarily in the relevant field and capable of uniformly dispersing the charge transporting substance, including, for example, polycarbonate, polyallylate, polyvinylbutyral, polyimide, polyester, polyketone, epoxy resin, polyurethane, polyvinylketone, polystyrene, polyacrylamide, phenolic resin, phenoxy resin, polysulfone resin, and copolymer resin thereof. Among those materials, in view of the film forming property, and the wear resistance, an electrical property etc. of the obtained charge transporting layer, it is preferable to use, for example, polycarbonate which contains bisphenol Z as the monomer ingredient (hereinafter referred to as "bisphenol Z polycarbonate"), and a mixture of bisphenol Z polycarbonate and other polycarbonate. The binder resin may be used each alone, or two or more of them may be used in combination.

The charge transporting layer preferably contains an antioxidant together with the charge transporting substance and the binder resin for charge transporting layer. Also for the antioxidant, substances used customarily in the relevant field can be used including, for example, Vitamin E, hydroquinone, hindered amine, hindered phenol, paraphenylene diamine, arylalkane and derivatives thereof, an organic sulfur compound, and an organic phosphorus compound. The antioxidants may be used each alone, or two or more of them may be used in combination. The content of the antioxidant is not particularly limited, and is 0.01% by weight to 10% by weight and preferably 0.05% by weight to 5% by weight of the total amount of the ingredients constituting the charge transporting layer.

The charge transporting layer can be formed by dissolving or dispersing an appropriate amount of a charge transporting substance, binder resin and, optionally, an antioxidant, a plasticizer, a sensitizer, etc. respectively in an appropriate organic solvent which is capable of dissolving or dispersing the ingredients described above, to thereby prepare a coating solution for charge transporting layer, and applying the coating solution for charge transporting layer to the surface of a charge generating layer followed by drying. The thickness of the charge transporting layer obtained in this way is not particularly limited, and preferably 10 μm to 50 μm and more preferably 15 μm to 40 μm.

Note that it is also possible to form a photosensitive layer in which a charge generating substance and a charge transporting substance are present in one layer. In this case, the kind and content of the charge generating substance and the charge transporting substance, the kind of the binder resin, and other additives may be the same as those in the case of forming separately the charge generating layer and the charge transporting layer.

In the embodiment, there is used a photoreceptor drum which has an organic photosensitive layer as described above containing the charge generating substance and the charge transporting substance. It is, however, also possible to use, instead of the above photoreceptor drum, a photoreceptor drum which has an inorganic photosensitive layer containing silicon or the like.

The charging section 12 faces the photoreceptor drum 11 and is disposed away from the surface of the photoreceptor drum 11 longitudinally along the photoreceptor drum 11. The charging section 12 charges the surface of the photoreceptor drum 11 so that the surface of the photoreceptor drum 11 has predetermined polarity and potential. As the charging section 12, it is possible to use a charging brush type charging device, a charger type charging device, a pin array type charging device, an ion-generating device, or the like. Although the charging section 12 is disposed away from the surface of the photoreceptor drum 11 in the embodiment, the configuration is not limited thereto. For example, a charging roller may be used as the charging section 12, and the charging roller may be disposed in pressure-contact with the photoreceptor drum. It is also possible to use a contact-charging type charger such as a charging brush or a magnetic brush.

The exposure unit 13 is disposed so that a light beam corresponding to each color information emitted from the exposure unit 13 passes between the charging section 12 and the developing device 14 and reaches the surface of the photoreceptor drum 11. In the exposure unit 13, the image information is converted into light beams corresponding to each color information of black, cyan, magenta, and yellow, and the surface of the photoreceptor drum 11 which has been evenly charged by the charging section 12, is exposed to the light beams corresponding to each color information to thereby form electrostatic latent images on the surfaces of the photoreceptor drums 11. As the exposure unit 13, it is possible to use a laser scanning unit having a laser-emitting portion and a plurality of reflecting mirrors. The other usable examples of the exposure unit 13 may include an LED array or a unit in which a liquid-crystal shutter and a light source are appropriately combined with each other.

The cleaning unit 15 removes the toner which remains on the surface of the photoreceptor drum 11 after the toner image has been transferred to the recording medium, and thus cleans the surface of the photoreceptor drum 11. In the cleaning unit 15, a platy member is used such as a cleaning blade. In the image forming apparatus 1 of the invention, an organic photoreceptor drum is mainly used as the photoreceptor drum 11. A surface of the organic photoreceptor drum contains a resin component as a main ingredient and therefore tends to be degraded by chemical action of ozone which is generated by corona discharging of the charging section. The degraded surface part is, however, worn away by abrasion through the cleaning unit 15 and thus removed reliably, though gradually. Accordingly, the problem of the surface degradation caused by the ozone, etc. is actually solved, and it is thus possible to stably maintain the potential of charges given by the charging operation over a long period of time. Although the cleaning unit 15 is provided in the embodiment, no limitation is imposed on the configuration and the cleaning unit 15 does not have to be provided.

In the toner image forming section 2, signal light corresponding to the image information is emitted from the exposure unit 13 to the surface of the photoreceptor drum 11 which has been evenly charged by the charging section 12, thereby forming an electrostatic latent image; the toner is then supplied from the developing device 14 to the electrostatic latent image, thereby forming a toner image; the toner image is transferred to an intermediate transfer belt 25; and the toner which remains on the surface of the photoreceptor drum 11 is removed by the cleaning unit 15. A series of toner image forming operations just described are repeatedly carried out.

The transfer section 3 is disposed above the photoreceptor drum 11 and includes the intermediate transfer belt 25, a driving roller 26, a driven roller 27, an intermediate transfer roller 28*b*, 28*c*, 28*m*, 28*y*, a transfer belt cleaning unit 29, and a transfer roller 30. The intermediate transfer belt 25 is an endless belt supported around the driving roller 26 and the driven roller 27 with tension, thereby forming a loop-shaped travel path. The intermediate transfer belt 25 rotates in an arrow B direction. The driven roller 27 can be driven to rotate by the rotation of the driving roller 26, and imparts constant tension to the intermediate transfer belt 25 so that the intermediate transfer belt 25 does not go slack. The intermediate transfer roller 28 is disposed in pressure-contact with the photoreceptor drum 11 with the intermediate transfer belt 25 interposed therebetween, and capable of rotating around its own axis by a drive portion (not shown). The intermediate transfer roller 28 is connected to a power source (not shown) for applying the transfer bias voltage as described above, and has a function of transferring the toner image formed on the surface of the photoreceptor drum 11 to the intermediate transfer belt 25.

When the intermediate transfer belt 25 passes by the photoreceptor drum 11 in contact therewith, the transfer bias voltage whose polarity is opposite to the polarity of the charged toner on the surface of the photoreceptor drum 11 is applied from the intermediate transfer roller 28 which is disposed opposite to the photoreceptor drum 11 with the intermediate transfer belt 25 interposed therebetween, with the result that the toner image formed on the surface of the photoreceptor drum 11 is transferred onto the intermediate transfer belt 25. In the case of a multicolor image, the toner images of respective colors formed on the respective photoreceptor drums 11 are sequentially transferred and overlaid onto the intermediate transfer belt 25, thus forming a multicolor toner image.

The transfer belt cleaning unit 29 is disposed opposite to the driven roller 27 with the intermediate transfer belt 25 interposed therebetween so as to come into contact with an outer circumferential surface of the intermediate transfer belt 25. When the intermediate transfer belt 25 contacts the photoreceptor drum 11, the toner is attached to the intermediate transfer belt 25 and may cause contamination on a reverse side of the recording medium, and therefore the transfer belt cleaning unit 29 removes and collects the toner on the surface of the intermediate transfer belt 25.

The transfer roller 30 is disposed in pressure-contact with the driving roller 26 with the intermediate transfer belt 25 interposed therebetween, and capable of rotating around its own axis by a drive portion (not shown). In a pressure-contact region (a transfer nip region) between the transfer roller 30 and the driving roller 26, a toner image which has been borne by the intermediate transfer belt 25 and thereby conveyed to the pressure-contact region is transferred onto a recording medium fed from the later-described recording medium feeding section 5. The recording medium bearing the toner image is fed to the fixing section 4.

In the transfer section 3, the toner image is transferred from the photoreceptor drum 11 onto the intermediate transfer belt 25 in the pressure-contact region between the photoreceptor drum 11 and the intermediate transfer roller 28, and by the intermediate transfer belt 25 rotating in the arrow B direction, the transferred toner image is conveyed to the transfer nip region where the toner image is transferred onto the recording medium.

The fixing section 4 is provided downstream of the transfer section 3 along a conveyance direction of the recording medium, and contains a fixing roller 31 and a pressure roller 32. The fixing roller 31 can rotate by a drive portion (not shown), and heats the toner constituting an unfixed toner image borne on the recording medium to fuse the toner. Inside the fixing roller 31 is provided a heating portion (not shown). The heating portion heats the heating roller 31 so that a surface of the heating roller 31 has a predetermined temperature (heating temperature). For the heating portion, a heater, a halogen lamp, and the like device can be used, for example. The heating portion is controlled by the fixing condition controlling portion.

In the vicinity of the surface of the fixing roller 31 is provided a temperature detecting sensor (not shown) which detects a surface temperature of the fixing roller 31. A result detected by the temperature detecting sensor is written to a memory portion of the later-described control unit. The pressure roller 32 is disposed in pressure-contact with the fixing roller 31, and supported so as to be driven to rotate by the rotation of the pressure roller 32. The pressure roller 32 allows a toner image to be fixed onto the recording medium in cooperation with the fixing roller 31. Then, the pressure roller 32 helps the toner image to be fixed onto the recording medium by pressing the toner image in a state of fusion by heat from the fixing roller 31 against the recording medium. A pressure-contact region between the fixing roller 31 and the pressure roller 32 is a fixing nip region.

In the fixing section 4, the recording medium onto which the toner image has been transferred in the transfer section 3 is nipped by the fixing roller 31 and the pressure roller 32 so that when the recording medium passes through the fixing nip region, the toner image is pressed and thereby fixed onto the recording medium under heat, whereby an image is formed.

The recording medium feeding section 5 includes an automatic paper feed tray 35, a pickup roller 36, conveying rollers 37, registration rollers 38, and a manual paper feed tray 39. The automatic paper feed tray 35 is disposed in a vertically lower part of the image forming apparatus 100 and in form of a container-shaped member for storing the recording mediums. Examples of the recording medium include plain paper, color copy paper, sheets for overhead projector, and postcards. The pickup roller 36 takes out sheet by sheet the recording mediums stored in the automatic paper feed tray 35, and feeds the recording mediums to a paper conveyance path P1. The conveying rollers 37 are a pair of roller members disposed in pressure-contact with each other, and convey the recording medium to the registration rollers 38. The registration rollers 38 are a pair of roller members disposed in pressure-contact with each other, and feed to the transfer nip region the recording medium fed from the conveying rollers 37 in synchronization with the conveyance of the toner image borne on the intermediate transfer belt 25 to the transfer rip region. The manual paper feed tray 39 is a device for taking the recording mediums into the image forming apparatus 100, and the recording mediums stored in the manual paper feed tray 39 are different from the recording mediums stored in the automatic paper feed tray 35 and may have any size. The recording medium taken in from the manual paper feed tray 39 passes through a paper conveyance path 92 by use of the conveying rollers 37, thereby being fed to the registration rollers 38. In the recording medium feeding section 5, the recording medium supplied sheet by sheet from the automatic paper feed tray 35 or the manual paper feed tray 39 is fed to the transfer nip region in synchronization with the conveyance of the toner image borne on the intermediate transfer belt 25 to the transfer nip region.

The discharging section 6 includes the conveying rollers 37, discharging rollers 40, and a catch tray 41. The conveying rollers 37 are disposed downstream of the fixing nip region along the paper conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus 1. The catch tray 41 stores the recording medium onto which the image has been fixed.

The image forming apparatus 100 includes a control unit (not shown). The control unit is disposed, for example, in an upper part of an internal space of the image forming apparatus 100, and contains a memory portion, a computing portion, and a control portion. To the memory portion of the control unit are inputted, for example, various set values obtained by way of an operation panel (not shown) disposed on the upper surface of the image forming apparatus 100, results detected from a sensor (not shown) etc. disposed in various portions inside the image forming apparatus 100, and image information obtained from an external equipment. Further, programs for operating various functional elements are written. Examples of the various functional elements include a recording medium determining portion, an attachment amount controlling portion, and a fixing condition controlling portion. For the memory portion, those customarily used in the relevant filed can be used including, for example, a read only memory (ROM), a random access memory (RAM), and a hard disk drive (HDD). For the external equipment, it is possible to use electrical and electronic devices which can form or obtain the image information and which can be electrically connected to the image forming apparatus 100. Examples of the external equipment include a computer, a digital camera, a television receiver, a video recorder, a DVD (digital versatile disc) recorder, an HDDVD (high-definition digital versatile disc), a Blu-ray disc recorder, a facsimile machine, and a mobile computer. The computing portion of the control unit takes out the various data (such as an image formation order, the detected result, and the image information) written in the memory portion and the programs for various functional elements, and then makes various determinations. The control portion of the control unit sends to a relevant device a control signal in accordance with the result determined by the computing portion, thus performing control on operations. The control portion and the computing portion include a processing circuit which is achieved by a microcomputer, a microprocessor, etc. having a central processing unit. The control unit contains a main power source as well as the above-stated processing circuit. The power source supplies electricity to not only the control unit but also respective devices provided inside the image forming apparatus 100.

5. Developing device

Figure 6:
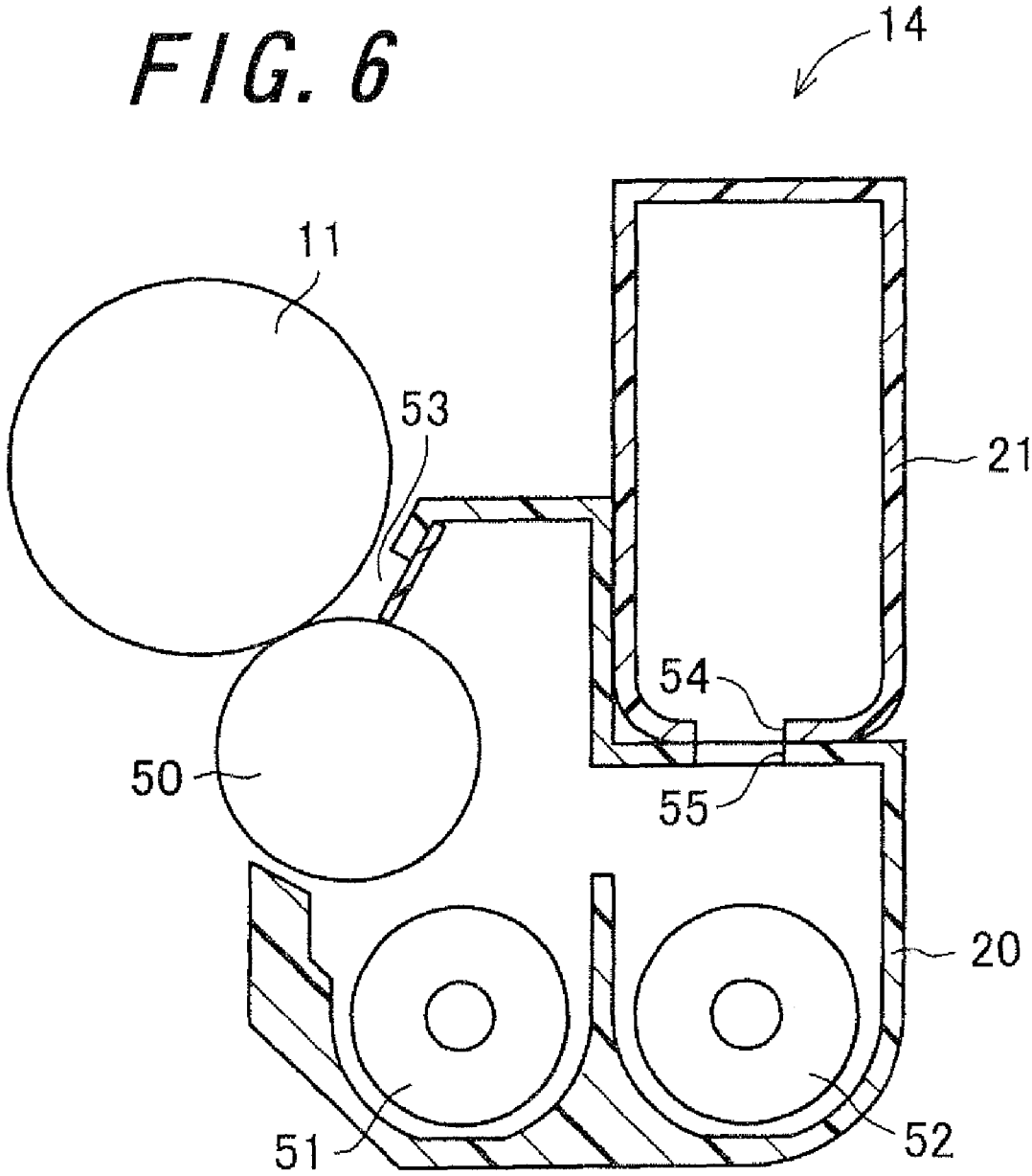
FIG. 6 is a schematic view schematically showing the developing device provided in the image forming apparatus shown in FIG. 5.

FIG. 6 is a schematic view schematically showing the developing device 14 provided in the image forming apparatus 100 shown in FIG. 5. The developing device 14 includes a developing tank 20 and a toner hopper 21. The developing tank 20 is a container-shaped member which is disposed so as to face the surface of the photoreceptor drum 11 and used to supply a toner to an electrostatic latent image formed on the surface of the photoreceptor drum 11 so as to develop the electrostatic latent image into a visualized image, i.e. a toner image. The developing tank 20 contains in an internal space thereof the toner, and rotatably supports roller members such as a developing roller 50, a supplying roller 51, and an agitating roller 52. Moreover, a screw member may be stored instead of the roller-like member. The developing device 14 of this embodiment stores the toner of the above embodiment in the developing tank 20 as a toner.

The developing tank 20 has an opening 53 in a side face thereof opposed to the photoreceptor drum 11. The developing roller 50 is rotatably provided at such a position as to face the photoreceptor drum 11 through the opening 53 just stated. The developing roller 50 is a roller-shaped member for supplying a toner to the electrostatic latent image on the surface of the photoreceptor drum 11 in a pressure-contact region or most-adjacent region between the developing roller 50 and the photoreceptor drum 11. In supplying the toner, to a surface of the developing roller 50 is applied potential whose polarity is opposite to polarity of the potential of the charged toner, which serves as development bias voltage. By so doing, the toner on the surface of the developing roller 50 is smoothly supplied to the electrostatic latent image. Furthermore, an amount of the toner being supplied to the electrostatic latent image (which amount is referred to as "toner attachment amount") can be controlled by changing a value of the development bias voltage.

The supplying roller 51 is a roller-shaped member which is rotatably disposed so as to face the developing roller 50 and used to supply the toner to the vicinity the developing roller 50.

The agitating roller 52 is a roller-shaped member which is rotatably disposed so as to face the supplying roller 51 and used to feed to the vicinity of the supplying roller 51 the toner which is newly supplied from the toner hopper 21 into the developing tank 20. The toner hopper 21 is disposed so that a toner replenishment port 54 formed in a vertically lower part of the toner hopper 21 is brought into communication with a toner reception port 55 formed in a vertically upper part of the developing tank 20. The toner hopper 21 replenishes the developing tank 20 with the toner according to toner consumption. Further, it may be possible to adopt such configuration that the developing tank 20 is replenished with the toner supplied directly from a toner cartridge of each color without using the toner hopper 21.

As described above, since the developing device 14 develops a latent image using the developer of the invention, it is possible to stably form a high-definition toner image on the photoreceptor drum 11. As a result, it is possible to form a high-quality image stably.

According to the invention, the image forming apparatus 100 is implemented by including the photoreceptor drum 11 on which a latent image is formed, the charging section 12 that forms the latent image on the photoreceptor drum 11, the exposure unit 13, and the developing device 14 of the invention capable of forming a high-definition toner image on the photoreceptor drum 11 as described above. By forming an image with such an image forming apparatus 100, it is possible to form an image having high definition and excellent image quality without unevenness in density.

EXAMPLES

Hereinafter, referring to examples and comparative examples, the invention will be specifically described. In the following description, unless otherwise noted, "parts" and "%" represent "parts by weight" and "% by weight" respectively. In the examples and the comparative examples, a glass transition temperature of the binder resin and the toner base particles, a softening temperature of the binder resin, a melting point of the release agent, and a volume average particle size of the toner base particles were measured as follows.

[Glass Transition Temperature of Binder Resin and Toner Base Particle]

Using a differential scanning calorimeter (trade name: DSC220, manufactured by Seiko Instruments & Electronics Ltd.), 1 g of sample (binder resin or toner base particle) was heated at a temperature increasing rate of 10° C./min to measure a DSC curve based on Japanese Industrial Standards (JIS) K7121-1987. A temperature at an intersection of a straight line that was elongated toward a low-temperature side from a base line on the high-temperature side of an endothermic peak corresponding to glass transition of the obtained DSC curve and a tangent line that was drawn so that a gradient thereof was maximum against a curve extending from a rising part to a top of the peak was obtained as the glass transition temperature ($T_g$).

[Softening Temperature of Binder Resin]

Using a flow characteristic evaluation apparatus (trade name: FLOW TESTER CFT-100C, manufactured by Shimadzu Corporation), 1 g of sample (binder resin) was heated at a temperature increasing rate of 6° C./min, under load of 20 kgf/cm$^2$ ($19.6\times10^5$ Pa) so that the sample was pushed out of a dye (nozzle opening diameter of 1 mm and length of 1 mm) and a temperature at the time when a half of the sample had flowed out of the dye was obtained as the softening temperature ($T_m$).

[Melting Point of Release Agent]

Using the differential scanning calorimeter (trade name: DSC220, manufactured by Seiko Instruments & Electronics Ltd.), 1 g of sample (release agent) was heated from a temperature of 20 up to 200° C. at a temperature increasing rate of 10° C./min, and then an operation of rapidly cooling down from 200° C. to 20° C. was repeated twice, thus measuring a DSC curve. A temperature at a top of an endothermic peak corresponding to the melting on the DSC curve measured at the second operation, was obtained as the melting point of the release agent.

[Volume Average Particle Size of Toner Base Particles]

To 50 ml of electrolyte (trade name: ISOTON-II, manufactured by Beckman Coulter, Inc.), 20 mg of sample (toner base particle) and 1 ml of sodium alkylether sulfate ester were added, and a thus-obtained admixture was subjected to dispersion processing of an ultrasonic distributor (trade name: desktop two-frequency ultrasonic cleaner VS-D100, manufactured by AS ONE Corporation) for three minutes at an ultrasonic frequency of 20 kHz, thereby preparing a sample for measurement. The measurement sample was analyzed by a particle size distribution-measuring device: MULTISIZER III (trade name) manufactured by Beckman Coulter, Inc. under the conditions that an aperture diameter was 100 μm and the number of particles for measurement was 50,000 counts. A volume particle size distribution of the sample particles was thus obtained from which the volume average particle size was then determined.

[Volume Average Particle Size of Fine Resin Particles]

Volume average particle size of fine resin particles was measured using a laser diffraction scattering method particle size distribution measurer (trade name: MICROTRAC MT300, manufactured by Nikkiso Co., Ltd.). To prevent aggregation of a measurement sample (fine resin particle), a dispersion having the measurement sample dispersed therein was introduced into an aqueous solution of FAMILY FRESH (manufactured by Kao Corporation), followed by stirring. The resulting mixture was poured in an apparatus, measurement was conducted two times, and the average was obtained. The measurement conditions were measurement time: 30 seconds, refractive index of particle: 1.4, particle shape: non-spherical, solvent: water, and refractive index of solvent: 1.33. Volume particle size distribution of the measurement sample was measured, and a particle size at which accumulated volume from a small particle size side in the accumulated volume distribution is 50% was calculated as a volume average particle size (μm) of particles from the measurement results.

Example 1

Toner Base Particle Producing Step S1

| | |
|---|---|
| Polyester resin (trade name: DIACRON, manufactured by Mitsubishi Rayon Co., Ltd., glass transition temperature of 55° C., softening temperature of 130° C.) | 87.5% (100 parts) |
| C.I. Pigment Blue 15:3 | 5.0% (5.7 parts) |
| Release agent (Carunauba Wax, melting point of 82° C.) | 6.0% (6.9 parts) |
| Charge control agent (trade name: Bontron E84, manufactured by Orient Chemical Industries, Co., Ltd.) | 1.5% (1.7 parts) |

After pre-mixing each of the constituent materials described above by a Henschel mixer (trade name: FM20C, manufactured by Mitsui Mining Co., Ltd.), the obtained mixture was melt and kneaded by a twin-screw extruder (trade name: PCM65 manufactured by Ikegai, Ltd.). After coarsely pulverizing the melt-kneaded material by a cutting mill (trade name: VM-16, manufactured by Orient Co., Ltd.), it was finely pulverized by a jet mill (manufactured by Hosokawa Micron Corporation) and then classified by a pneumatic classifier (manufactured by Hosokawa Micron Corporation) to produce toner base particles with a volume average particle size of 6.5 μm and a glass transition temperature of 56° C.

[Fine Resin Particle Preparing Step S2]

As fine resin particles, styrene-butyl acrylate copolymer fine particles A (glass transition temperature: 72° C., softening point: 126° C.) having a volume average particle size of 0.1 μm were provided. The fine resin particles were obtained by freeze drying a polymer obtained by polymerizing styrene and butyl acrylate. As a liquid to be sprayed, ethanol was provided.

[Pre-Mixing Step S3]

By using Hybridization system (trade name: NHS-1 Model, manufactured by Nara Machinery Co., Ltd.) in accordance with the apparatus shown in FIG. 2, the toner base particles and the fine resin particles were stirred and fluidized.

The temperature regulation jacket was provided on the entire surfaces of the powder passage and the inner wall of the stirring section, like the apparatus shown in FIG. 3. A chiller was used as a temperature regulation controlling apparatus of the temperature regulation jacket. Temperature of circulation water at the time of non-load before inputting a powder (toner base particles and fine resin particles) in the first temperature regulation step S3*a* was set to 5° C., and temperature of the powder passage shown by a temperature sensor provided in the powder passage was regulated to be 50° C. in the fine resin particle fixation step S3*d*.

In this apparatus, peripheral speed at the outermost periphery of the rotary stirring section of the Hybridization system was 80 m/sec in the fine resin particle disaggregating step S3*c* and the fine resin particle fixation step S3*d* to the surface of the toner base particle. Stirred and mixed were 100 parts by weight of the toner base particles and 10 parts of the fine resin particles, prepared in the toner base particle producing step S1 and the fine resin particle preparing step S2, for 10 minutes. Fine resin particle-fixed toner having the fine resin particles fixed to the surface of the toner base particle was taken out of the powder recovery section, and recovered in a storage bag made of polyethylene. Air flow rate discharged to outside the apparatus was 10 liters per minute in combination with air flow rate from a two-fluid nozzle by adjusting air flow rate flown in the apparatus from the rotary shaft to 5 liters per minute. Powder can be prevented from flowing in a sliding portion of the rotary shaft by flowing air in the apparatus from the rotary shaft. Furthermore, pressure in the powder passage can be adjusted by discharging air.

The time between recovery and input in the coating step S4, deterioration in state, such as generation of an aggregate, was not observed in the fine resin particle-fixed toner.

[Coating Step S4]

In the present step, an apparatus comprising the Hybridization system (trade name: NHS-1 Model, manufactured by Nara Machinery Co., Ltd.) and a two-fluid nozzle attached thereto was used. Commercially available products can be used as a liquid spraying unit spraying ethanol as a liquid in the state where the toner, comprising the toner fine particles and the fine resin particles fixed to the surface thereof, obtained by the pre-mixing step S3, is stirred and fluidized. For example, an apparatus having connected thereto a liquid-sending pump (trade name: SP11-12, manufactured by Flom Co., Ltd.) which sends a liquid in a quantitative amount to a two-fluid nozzle (trade name: HM-6 Model, manufactured by Fuso Seiki Co., Ltd.) through the pump can be used. Liquid spraying speed and liquid gas discharge speed can be observed using the commercially available gas detector (trade name: XP-3110, manufactured by New Cosmos Electric Co., Ltd.).

The temperature regulation jacket was provided on the entire surfaces of the powder passage and the inner wall of the rotary stirring section, like the pre-mixing step S3. A chiller was used as a temperature regulation controlling apparatus of the temperature regulation jacket in the second temperature regulation step S4*a*. Temperature of circulation water at the time of no-load before inputting a powder was set to 25° C., and temperature of the powder passage shown by a temperature sensor provided in the powder passage was regulated to be 55° C. in the spraying step S4*c* and the film-forming step S4*d*.

In the above-described apparatus, a peripheral speed in the outermost peripheral of the rotary stirring section of the Hybridization system was 100 m/sec at the fine resin particle adhering step to the surface of a toner base particle. The peripheral speed was also 100 m/sec at the spraying step S4*c* and the film-forming step S4*d*. Moreover, an installation angle of the two-fluid nozzle was set so that an angle formed by the liquid spraying direction and the powder flowing direction (hereinafter referred to as "spraying angle") is in parallel (0°).

After stirring the toner fixed by fine resin particles that was prepared in the pre-mixing step S3 for five minutes by the apparatus, ethanol as the liquid was sprayed for thirty minutes at spraying speed of 0.5 g/min and an air flow of 5 L/min to film-form the fine resin particles on the surface of the toner base particle. Then, spraying of the ethanol was stopped, followed by stirring for five minutes, to obtain a toner of Example 1. In this case, an exhaust concentration of the substance exhausted through the through-hole and the gas exhausting section was stable at about 1.4 Vol %. Moreover, the air flow into the apparatus was 10 L/min in total with the air flow from the two-fluid nozzle by adjusting the air flow from the rotary shaft into the apparatus to 5 L/min.

Figure 7:
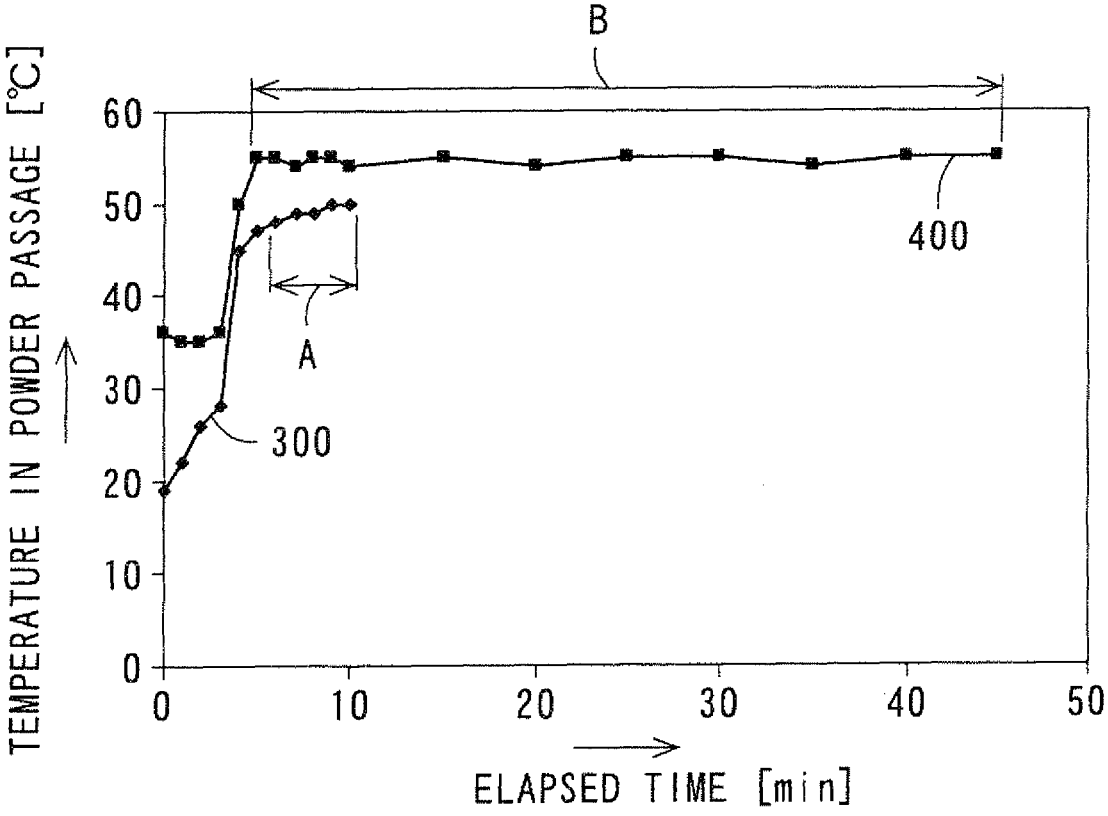
FIG. 7 is a graph showing changes in temperature in the powder passage from the initiation point of the respective steps in the pre-mixing step S3 and the coating step S4 of Example 1.

FIG. 7 is a graph showing changes in temperature in the powder passage from the initiation point of the respective steps in the pre-mixing step S3 and the coating step S4 of Example 1. The changes in temperature of the pre-mixing step S3 are shown by a curve 300. The changes in temperature of the coating step S4 are shown by a curve 400. It is seen that during a period A in the pre-mixing step S3, the temperature in the powder passage is the pre-mixing stabilization temperature, and during a period B in the coating step S4, the temperature in the powder passage is the coating stabilization temperature. As in the graph of FIG. 7, it is preferred in the invention that the pre-mixing stabilization temperature is regulated to a temperature lower than the coating stabilization temperature, and the temperature in the powder passage in the pre-mixing step S3 is regulated so as to be always lower than the temperature in the powder passage of the coating step S4 in the same elapsed time from the initiation of the respective steps. In the following Examples and Comparative Examples, the temperature at the initiation point of steps, the pre-mixing stabilization temperature and the coating stabilization temperature differ, respectively, but substantially same changes in temperature as the changes in temperature in the powder passage in Example 1 are obtained.

Example 2

A toner of Example 2 was obtained in the same manner as in Example 1, except that the temperature of circulation water of the chiller at the time of no-load before inputting a powder was set to 10° C. in the pre-mixing step S3.

Example 3

A toner of Example 3 was obtained in the same manner as in Example 1, except that the temperature of circulation water of the chiller at the time of no-load before inputting a powder was set to 15° C. in the coating step S4.

Example 4

A toner of Example 4 was obtained in the same manner as in Example 1, except that the temperature of circulation water of the chiller at the time of no-load before inputting a powder was set to 12° C. in the pre-mixing step S3 and the temperature of circulation water of the chiller at the time of no-load before inputting a powder was set to 30° C. in the coating step S4.

Example 5

A toner of Example 5 was obtained in the same manner as in Example 1, except that the temperature of circulation water of the chiller at the time of no-load before inputting a powder was set to 30° C. in the coating step S4.

Example 6

A toner of Example 6 was obtained in the same manner as in Example 1, except that the temperature of circulation water of the chiller at the time of no-load before inputting a powder was set to 10° C. in the pre-mixing step S3 and the temperature of circulation water of the chiller at the time of no-load before inputting a powder was set to 30° C. in the coating step S4.

Example 7

A toner of Example 7 was obtained in the same manner as in Example 1, except that two Hybridization systems were used, the pre-mixing step S3 was conducted using a first Hybridization system, the coating step S4 was conducted using a second Hybridization system, the temperature of circulation water of the chiller at the time of no-load before inputting a powder was set to 10° C. in the pre-mixing step S3 and the temperature of circulation water of the chiller at the time of no-load before inputting a powder was set to 30° C. in the coating step S4.

Example 8

A toner of Example 8 was obtained in the same manner as in Example 1, except that the temperature of circulation water of the chiller at the time of no-load before inputting a powder was set to 20° C. in the coating step S4.

Comparative Example 1

A toner of Comparative Example 1 was obtained in the same manner as in Example 1, except that the temperature of circulation water of the chiller at the time of no-load before inputting a powder was set to 25° C. in the first temperature regulation step S3*a*, the fine resin particle-fixed toner was not recovered in the pre-mixing step S3, and continuously the coating step S4 was conducted.

Comparative Example 2

A toner of Comparative Example 2 was obtained in the same manner as in Example 1, except that the temperature of circulation water of the chiller at the time of no-load before inputting a powder was set to 15° C. in the first temperature regulation step S3*a*, the fine resin particle-fixed toner was not recovered in the pre-mixing step S3, and continuously the coating step S4 was conducted.

Comparative Example 3

A toner of Comparative Example 3 was obtained in the same manner as in Example 1, except that the temperature of circulation water of the chiller at the time of no-load before inputting a powder was set to 5° C. in the first temperature regulation step S3*a*, the fine resin particle-fixed toner was not recovered in the pre-mixing step S3, and continuously the coating step S4 was conducted.

Comparative Example 4

A toner of Comparative Example 4 was obtained in the same manner as in Example 1, except that temperature regulation of the powder passage was not conducted in the pre-mixing step S3 and the coating step S4, the fine resin particle-fixed toner was not recovered in the pre-mixing step S3, and continuously the coating step S4 was conducted.

Comparative Example 5

A toner of Comparative Example 5 was obtained in the same manner as in Example 1, except that temperature regulation of the powder passage was not conducted in the pre-mixing step S3 and the coating step S4.

Comparative Example 6

A toner of Comparative Example 6 was obtained in the same manner as in Example 1, except that temperature regulation of the powder passage was not conducted in the pre-mixing step S3.

Comparative Example 7

A toner of Comparative Example 7 was obtained in the same manner as in Example 1, except that temperature regulation of the powder passage was not conducted in the coating step S4.

Comparative Example 8

A toner of Comparative Example 8 was obtained in the same manner as in Example 1, except that the temperature of circulation water of the chiller at the time of no-load before inputting a powder was set to 15° C. in the pre-mixing step S3.

Comparative Example 9

A toner of Comparative Example 9 was obtained in the same manner as in Example 1, except that the temperature of circulation water of the chiller at the time of no-load before inputting a powder was set to 10° C. in the coating step.

Comparative Example 10

A toner of Comparative Example 10 was obtained in the same manner as in Example 1, except that the temperature of circulation water of the chiller at the time of no-load before inputting a powder was set to 10° C. in the pre-mixing step and the temperature of circulation water of the chiller at the time of no-load before inputting a powder was set to 15° C. in the coating step.

The toners obtained in Examples 1 to 8 and Comparative Examples 1 to 10 were evaluated on coating uniformity, yield and productivity as follows.

<Coating Uniformity>

The coating uniformity was evaluated depending on presence/absence of an aggregate after high-temperature storage using the toners of Examples and Comparative Examples. After 20 g of toners were sealed in a plastic container and have been left for forty-eight hours at 50° C., the toners were taken out and passed through a 230-mesh sieve. The weight of the toners remaining on the sieve was measured and the remaining amount which is a ratio of the weight to the total weight of the toners was obtained to perform the evaluation based on the following standards. The lower value shows that the toner is not blocked and preservability, that is, coating uniformity is excellent.

Evaluation standard of the coating uniformity is as follows.

Excellent: Very favorable. Aggregate is not visually confirmed. Residual amount is 1% or less.

Good: Favorable. Aggregate is not visually confirmed. Residual amount is more than 1% to less than 3%.

Not bad: Practically no problem. Aggregate is visually confirmed in small amount. Residual amount is 3% to less than 20%.

Poor: No good. Aggregate is visually confirmed in large amount. Residual amount is 20% or more.

<Yield>

Yield of the toner was calculated by the following equation (1).

$$\text{Yield of toner}=\{\text{Weight of toner recovered}/(\text{amount of toner base particles inputted}+\text{amount of fine resin particles inputted})\}\times 100 \quad (1)$$

Evaluation standard of the yield is as follows.

Excellent: Very favorable. Yield of toner calculated is 95% or more.

Good: Favorable. Yield of toner calculated is 90 to less than 95%.

Not bad: Practically no problem. Yield of toner calculated is 80 to less than 90%.

Poor: No good. Yield of toner calculated is less than 80%.

<Comprehensive Evaluation>

The comprehensive evaluation result was obtained on the basis of the above evaluation results.

Evaluation standard of the comprehensive evaluation result is as follows.

Excellent: Very favorable. The evaluation results of coating uniformity and yield are not rated as "Poor" and "Not bad", and at least one of the evaluation results is rated as "Excellent".

Good: Favorable. The evaluation results of coating uniformity and yield are rated as "Good".

Poor: No good. Other than the comprehensive evaluation results of "Very favorable" and "Favorable".

The evaluation results are shown in Table 1.

As shown in Table 1, (1) when the peak temperature of the powder passage in the pre-mixing step was too high (increased to about 60° C.), disaggregation of a secondary aggregate of the fine resin particles was not efficiently conducted, and the particle size of the fine resin particles fixed to the surface of the toner base particle after mixing was 10 times or more the primary particle size. In the case that disaggregation was not sufficiently conducted by the pre-mixing, exposure of the surface of the toner base particle and surface irregularities were remarkably observed after the coating, and the tendency had been to deteriorate the coating uniformity. Furthermore, adhesion to the powder passage was greatly observed, and the yield was deteriorated.

(2) When the peak temperature of the powder passage in the coating step was too low (lower than 50° C.), spreading of the fine resin particles was not sufficiently conducted, and the tendency had been to exhibit a discontinuous film state with remarkable irregularities.

(3) When the peak temperature of the powder passage in the coating step was too high (increased to about 60° C.), spreading of the fine resin particles was not sufficiently conducted, and the tendency had been to exhibit a discontinuous film state with remarkable irregularities. Furthermore, adhesion to the powder passage was greatly observed, and the yield was deteriorated.

The invention may be embodied in other specific forms without departing from the spirit or essential characteristics thereof. The present embodiments are therefore to be consid-

TABLE 1

| | Pre-mixing step | | | Coating step | | | Coating uniformity | | Yield | | Comprehensive evaluation |
|---|---|---|---|---|---|---|---|---|---|---|---|
| | Temperature regulation | Initial temperature of circulation water of chiller (° C.) | Peak temperature in powder passage (° C.) | Temperature regulation | Initial temperature of circulation water of chiller (° C.) | Peak temperature in powder passage (° C.) | Residual amount (%) | Evaluation | Yield (%) | Evaluation | |
| Ex. 1 | Regulated | 5 | 50 | Regulated | 25 | 55 | 0 | Excellent | 92 | Good | Excellent |
| Ex. 2 | Regulated | 10 | 55 | Regulated | 25 | 55 | 0.5 | Excellent | 91 | Good | Excellent |
| Ex. 3 | Regulated | 5 | 50 | Regulated | 15 | 50 | 1 | Excellent | 95 | Excellent | Excellent |
| Ex. 4 | Regulated | 12 | 57 | Regulated | 30 | 58 | 2 | Good | 90 | Good | Good |
| Ex. 5 | Regulated | 5 | 50 | Regulated | 30 | 58 | 0.3 | Excellent | 91 | Good | Excellent |
| Ex. 6 | Regulated | 10 | 55 | Regulated | 30 | 58 | 0.8 | Excellent | 91 | Good | Excellent |
| Ex. 7 | Regulated | 10 | 56 | Regulated | 30 | 58 | 1.2 | Good | 90 | Good | Good |
| Ex. 8 | Regulated | 5 | 50 | Regulated | 20 | 53 | 0.4 | Excellent | 94 | Good | Excellent |
| Comp. Ex. 1 | Regulated | 25 | 62 | Regulated | — | 56 | 42 | Poor | 71 | Poor | Poor |
| Comp. Ex. 2 | Regulated | 15 | 60 | Regulated | — | 52 | 31 | Poor | 82 | Not bad | Poor |
| Comp. Ex. 3 | Regulated | 5 | 50 | Regulated | — | 45 | 36 | Poor | 97 | Excellent | Poor |
| Comp. Ex. 4 | None | — | 65 | None | — | 60 | 43 | Poor | 62 | Poor | Poor |
| Comp. Ex. 5 | None | — | 65 | None | — | 58 | 44 | Poor | 64 | Poor | Poor |
| Comp. Ex. 6 | None | — | 65 | Regulated | 25 | 55 | 45 | Poor | 66 | Poor | Poor |
| Comp. Ex. 7 | Regulated | 5 | 50 | None | — | 60 | 2.5 | Good | 83 | Not bad | Poor |
| Comp. Ex. 8 | Regulated | 15 | 60 | Regulated | 25 | 55 | 25 | Poor | 72 | Poor | Poor |
| Comp. Ex. 9 | Regulated | 5 | 50 | Regulated | 10 | 48 | 28 | Poor | 96 | Excellent | Poor |
| Comp. Ex. 10 | Regulated | 10 | 55 | Regulated | 15 | 50 | 5.5 | Not bad | 92 | Good | Poor |

ered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method for manufacturing a toner having a film which is formed on a toner base particle containing a binder resin and a colorant by adhering fine resin particles to a surface of the toner base particle, comprising:

a pre-mixing step of obtaining a fine resin particle-fixed toner by fixing disaggregated fine resin particles obtained by disaggregating a secondary aggregate of fine resin particles, to a surface of the toner base particle, while mixing and stirring toner base particles and the fine resin particles using a rotary stirring apparatus, the rotary stirring apparatus comprising a rotary stirring section including a rotary disk having rotary vanes provided on the circumference thereof, and a rotary shaft, a temperature regulation section which is provided in at least a part of a powder passage including a rotary stirring chamber and a circulation tube and regulates the temperature in the rotary stirring section and the powder passage to a predetermined temperature, a circulating section which repeatedly circulates toner base particles and fine resin particles in the powder passage by the rotary stirring section, and a spraying section which sprays a liquid having the effect of plasticizing the toner base particle and the fine resin particles; and a coating step of spraying the liquid to the fine resin particle-fixed toner in a fluidized state obtained in the pre-mixing step with the spraying section, and spreading the fine resin particles on the surface of the toner base particle, thereby forming a film of the fine resin particles, using the rotary stirring apparatus, in the pre-mixing step and the coating step, temperature regulation being conducted in the temperature regulation section, and a pre-mixing stabilization temperature which is a temperature in the powder passage, elevated from the initiation point of the pre-mixing step and stabilized in the pre-mixing step being lower than a coating stabilization temperature which is a temperature in the powder passage, elevated from the initiation point of the coating step and stabilized in the coating step.

2. The method of claim 1, wherein in the pre-mixing step and the coating step, the temperature in the powder passage in the pre-mixing step is always lower than the temperature in the powder passage in the coating step in the same elapsed time from the initiation of the respective steps.

3. The method of claim 1, wherein the pre-mixing step includes:

a first temperature regulation step of regulating the temperature in the rotary stirring section and the powder passage to 55° C. or lower by the temperature regulation section;

a disaggregating step of disaggregating a secondary aggregate of the fine resin particles by inputting the toner base particles and the fine resin particles into the rotary stirring chamber in which the rotary stirring section rotates; and a fixation step of fixing the disaggregated fine resin particles to the surface of the toner base particle.

4. The method of claim 1, wherein the coating step includes:

a second temperature regulation step of regulating the temperature in the rotary stirring section and the powder passage to 50° C. or higher and 55° C. or lower by the temperature regulation section;

a spraying step of spraying the liquid to the fine resin particle-fixed toner in a fluidized state by a carrier gas from the spraying section by inputting the fine resin particle-fixed toner obtained in the pre-mixing step into the powder passage in which the rotary stirring section rotates; and a film-forming step of forming a film of the fine resin particles on the surfaces of the toner base particles by fluidizing the fine resin particle-fixed toner while rotating the rotary stirring section until the fine resin particles on the surface of the toner base particle soften and form a film.

5. The method of claim 1, wherein the temperature in the whole powder passage and the rotary stirring section can be regulated to a predetermined temperature by the temperature regulation section in the coating step.

6. The method of claim 1, wherein when a peak temperature in the powder passage in the coating step is T2 and a glass transition temperature of the toner base particles is Tg(1), a relationship between T2 and Tg(1) is T2<Tg(1).

7. A method for manufacturing a toner having a film which is formed on a toner base particle containing a binder resin and a colorant by adhering fine resin particles to a surface of the toner base particle, comprising:

a pre-mixing step of obtaining a fine resin particle-fixed toner by fixing disaggregated fine resin particles obtained by disaggregating a secondary aggregate of fine resin particles, to the surface of the toner base particle, while mixing and stirring toner base particles and fine resin particles using a first rotary stirring apparatus, the first rotary stirring apparatus comprising a first rotary stirring section including a rotary disk having rotary vanes provided on the circumference thereof, and a rotary shaft, and a first temperature regulation section which is provided in at least a part of a first powder passage including a first rotary stirring chamber and a first circulation tube and regulates the temperature in a first powder passage and the first rotary stirring section to a predetermined temperature; and a coating step of spraying a liquid having the effect of plasticizing the fine resin particle-fixed toner to the fine resin particle-fixed toner in a fluidized state obtained in the pre-mixing step with a spraying section, and spreading the fine resin particles on the surface of the toner base particle, thereby forming a film of the fine resin particles, using a second rotary stirring apparatus, the second rotary stirring apparatus comprising a second rotary stirring section including a rotary disk having rotary vanes provided on the circumference thereof, and a rotary shaft, a second temperature regulation section which is provided in at least a part of a second powder passage including a second rotary stirring chamber and a second circulation tube and regulates the temperature in the second rotary stirring section and the second powder passage to a predetermined temperature, a circulating section which repeatedly circulates the fine resin particle-fixed toner in the powder passage with the second rotary stirring section, and the spraying section which sprays the liquid, in the pre-mixing step, temperature regulation being conducted in the first temperature regulation section, in the coating step, temperature regulation being conducted in the second temperature regulation section, and a pre-mixing stabilization temperature which is a temperature in the first powder passage, elevated from the initiation point of the pre-mixing step and stabilized in the pre-mixing step being lower than a coating stabilization temperature which is a temperature in the second powder passage, elevated from the initiation point of the coating step and stabilized in the coating step.

8. The method of claim 7, wherein when manufacturing plural toners, a continuous concurrent treatment is conducted such that the coating step for manufacturing a toner is conducted with the second rotary stirring apparatus, and simultaneously, the pre-mixing step for manufacturing a toner different from the toner in which the coating step is conducted is conducted with the first rotary stirring apparatus.

9. The method of claim of claim 7, in the pre-mixing step and the coating step, the temperature in the first powder passage in the pre-mixing step is always lower than the temperature in the second powder passage in the coating step in the same elapsed time from the initiation of the respective steps.

10. The method of claim 7, wherein the pre-mixing step includes:

a first temperature regulation step of regulating the temperature in the first rotary stirring section and the first powder passage to 55° C. or lower by the first temperature regulation section;

a disaggregating step of disaggregating a secondary aggregate of the fine resin particles by inputting the toner base particles and the fine resin particles into the first rotary stirring chamber in which the first rotary stirring section rotates; and a fixation step of fixing the disaggregated fine resin particles to the surface of the toner base particle.

11. The method of claim 7, wherein the coating step includes:

a second temperature regulation step of regulating the temperature in the second rotary stirring section and the second powder passage to 50° C. or higher and 55° C. or lower by the second temperature regulation section;

a spraying step of spraying the liquid to the fine resin particle-fixed toner in a fluidized state by a carrier gas from the spraying section by inputting the fine resin particle-fixed toner obtained in the pre-mixing step into the second powder passage in which the second rotary stirring section rotates; and a film-forming step of forming a film of the fine resin particles on the surfaces of the toner base particles by fluidizing the fine resin particle-fixed toner while rotating the second rotary stirring section until the fine resin particles on the surfaces of the toner base particles soften and form a film.

12. The method of claim 7, wherein the temperature in the whole second powder passage and the second rotary stirring section can be regulated to a predetermined temperature by the second temperature regulation section in the coating step.

13. The method of claim 7, wherein when a peak temperature in the second powder passage in the coating step is T2 and a glass transition temperature of the toner base particles is Tg(1), a relationship between T2 and Tg(1) is T2 <Tg(1).

* * * * *